US006213876B1

(12) United States Patent
Moore, Jr.

(10) Patent No.: US 6,213,876 B1
(45) Date of Patent: Apr. 10, 2001

(54) METHOD OF PLAYING DICE GAME

(76) Inventor: Naif Moore, Jr., 801 Regents Dr. E., Mobile, AL (US) 36609

( * ) Notice: Subject to any disclaimer, the term of this patent is extended or adjusted under 35 U.S.C. 154(b) by 0 days.

(21) Appl. No.: 09/246,651

(22) Filed: Feb. 8, 1999

Related U.S. Application Data

(63) Continuation-in-part of application No. 08/831,012, filed on Mar. 19, 1997, now Pat. No. 5,964,463, and a continuation-in-part of application No. 08/572,026, filed on Dec. 14, 1995, now Pat. No. 5,829,748.

(60) Provisional application No. 60/003,856, filed on Sep. 15, 1995, provisional application No. 60/016,256, filed on Apr. 24, 1996, and provisional application No. 60/021,073, filed on Mar. 27, 1996.

(51) Int. Cl.[7] ..... G07F 17/34; A63F 9/00

(52) U.S. Cl. ..... 463/22; 463/20; 273/143 R; 273/138.2

(58) Field of Search ..... 273/138.1, 138.2, 273/145 C, 143 R, 145 R; 463/20, 22

(56) References Cited

U.S. PATENT DOCUMENTS 3,715,624 * 2/1973 Herman ..... 273/138.2
4,506,890 * 3/1985 Murry ..... 463/22
5,031,914 * 7/1991 Rosenthal ..... 273/146

FOREIGN PATENT DOCUMENTS

2190227 * 11/1987 (GB) ..... 273/143 R

* cited by examiner

*Primary Examiner*—Benjamin H. Layno

(57) ABSTRACT

A dice game embodied in a table or slot machine format utilizing preferably two dice outputs to generate numbers based multiple repetitions or a count of numbers prior to novel termination and payout events. The preferred embodiment allows for payouts where a number is repeated at least two times before a termination event. The invention further comprising a randomizing device having uneven surfaces for the randomizing of dice rolls. The invention is further described as a method of wagering where a video or column type display is given for consecutive dice rolls of a predetermined and finite number of rolls with a payout based on the combination of the consecutive dice rolls over the predetermined number of rolls.

15 Claims, 18 Drawing Sheets

METHOD OF PLAYING DICE GAME

HISTORY

This is a continuation in part of the provisional patents by the same inventor filed as case: Ser. No.: 08/831,012 filed Mar. 19, 1997 now U.S. Pat. No. 5,964,463 Ser. No.: 60/003,856 filed Sep. 15, 1995, provisional filing 60/016,256 filed Apr. 24, 1996 and provisional filing 60/021,073 filed Mar. 27, 1996 and is a continuation in part of U.S. application Ser. No. 08/572,026 filed Dec. 14, 1995 by N. M. Moore, Jr. now U.S. Pat. No. 5,829,748. It is also a formal patent based on the disclosure statement filed as 380420.

This game has been, in part, previously disclosed in patent applications cited above.

BACKGROUND OF INVENTION

The invention relates generally to dice games utilizing two sets of dice generating numbers between two and twelve.

GENERAL DESCRIPTION OF THE INVENTION

Structure of the Table

The invention described herein may be used on a traditional craps table or on a Four The Money Table.

The size of the table in a sit down version using a chute as described below, may be 7×3½ feet, and is shaped similar to a blackjack table as shown in FIG. 2. Built in, is a computerized electronic controlled board designed to light up certain embodiments. These lit embodiments will be covered by a plexiglass top to protect the electronic lighted areas of this table.

The table has player locations 33 which allow the player to maintain all odds bets locations 5–14, for the money bets and some 'side bets' such as Forty O'Lordy 4 and all or nothing locations 3.

The Chute (FIGS. 4*a,* 4*b* and 4*c*) is provided, particularly in a sit down version to insure a good roll of the dice.

FOUR THE MONEY GAME

This particular game is largely disclosed in the prior filing. An electrical display system is preferably incorporated into the table or attached to the table in an urn 45. The dealer will enter the Start of Roll and each roll (die by die) and the appropriate display lights will advise players and the dealer of awards to be made and bets to be swept.

Aside from traditional craps, several games generally disclosing the roll of dice in obtaining winning combinations exist. The preferred embodiment may have a target event (such as a 6 and an 8 being rolled), usually a single target number (in the preferred embodiment a seven (7)), and allowing for a win when any number of rolls over a specified minimum number, preferably four (4), are made without generating the target event (rolling the target number, seven). Certain numbers may be excluded in determining the specified minimum number. Side games, all based on avoidance or attainment of a number of rolls or certain rolls during the period between the initial roll and the target roll may be made. These may be similar to those wagers available in traditional dice games based around either one roll or two rolls of a single number prior to rolling a seven.

Winning is tied to having a significant number of dice rolls sequentially.

For example, a traditional craps roll will end or reach a termination event when a come out point 4–6 or 8–10, followed by a 7 before repeating the come out point.

Four the money also counts four rolls before a seven as the basis of winning in the preferred embodiment. Similarly, in other embodiments the number of rolls before a six (6) and eight (8) (a target event using two target numbers) could be the method of determining when a win occurs.

Peat and Repeat, Different Doubles, and normal place bets along with the other disclosure below reflect methods of practicing side bets.

In order to determine the relative odds for a payout and in order to determine what is a fair number of rolls necessary in order to justify a win, statistics are applied to the probability of rolling multiple times before a target is rolled. For example, you could have four rolls prior to the roll of a seven or five rolls prior to the roll of a six or eight without leaving the basic embodiment of the game.

Under the terms of Four the Money Wager, only multiple rolls prior to the roll of a seven results in a payout.

"FOUR THE MONEY™"

To qualify as a shooter a player has the mandatory obligation of making a minimum "FOUR THE MONEY WAGER". In traditional craps, to qualify as a shooter, a pass or don't pass bet must be made. For non-shooters there is no obligation, this bet is optional. If a player chooses not to make a "FOUR THE MONEY WAGER" or come out on traditional craps, true odds will not be allowed.

The amount wagered on either of these features is optional as long as it is within the minimum and maximum allowed by each casino. The true odds allowed will be based solely on this wager. If a non-shooter chooses not to make this bet they still qualify for play on all features other than true odds.

"FOUR THE MONEY" wagers are placed on circles in front of each player. All bets on this feature must be placed before the first roll or after every fourth roll thereafter. To win a "FOUR THE MONEY WAGER" the shooter must roll the dice four times without a seven appearing. If a seven does appear within the four rolls all "FOUR THE MONEY" wagers lose. All other numbers that can appear other than a seven, are available for "FOUR THE MONEY WAGER" players to take true odds including odd or even roll bets.

The numbers rolled on the dice each time are keyed into a keyboard by the dealer. This action displays the number rolled as well as the number of rolls made by each shooter.

MATHEMATICAL ANALYSIS

"FOUR THE MONEY WAGER™" requires that four consecutive rolls be made without a seven appearing. This wager is paid out at even money (1-1). Since the probability of winning is 0.4822 the house advantage is 3.55%. Players must wager on this feature prior to the shooter's first of every four rolls.

True odds can be taken when the "FOUR THE MONEY WAGER" is bet before the initial roll and to be changed with each successive role as described in the original specification and under the direct control of the player (i.e. the player places his odds wagers himself on a location provided therefor before him).

TRUE ODDS

In order to make the video game more interactive and induce players to increase the amount wagered, any player who bets on "FOUR THE MONEY" is entitled to play the TRUE ODDS bets on individual numbers from 2 through 12 and odd or even. To win, the selected numbers must be rolled before a "7". The pay outs are:

6-1 on 2 and 12, 3-1 on 3 and 11, 2-1 on 4 and 10, 3-2 on 5 and 9,
6-5 on 6 and 8.

Since these are at true odds, the house has no advantage in them. They serve as an incentive for players to play "FOUR THE MONEY WAGER™" If a player lays or takes 10 times odds, the house advantage of the combined "FOUR THE MONEY WAGER™" and ODDS bets is reduced to 0.32% of the total at stake.

ODD OR EVEN NUMBER ROLL™

There are thirty six possible combinations that can be rolled with two dice. Eighteen of these combinations are 3-5-7-9-11 while eighteen are 2-4-6-8-10-12. Therefore, it is an even money bet as to whether the number that is rolled with two dice is an odd or even number. Since true odds are offered with this feature there is no house advantage. Bets made on this feature are counted as the true odds allowed. A bet must be made on the "FOUR THE MONEY WAGER™" or come out roll in traditional craps, in order to place a wager on odd or even number roll.

HOW TO PLAY

One of the unique features offered is "FOUR THE MONEY™" wagers can bet odd, even or choose any or all numbers 2 through 12 (no seven) to take true odds before making any roll including the first. These odds wagers can be taken in any mixture the player chooses as long as the total on all odds wager does not exceed the amount of odds allowed. The odds allowed will be based on a multiple of each player's "FOUR THE MONEY WAGER™". If a non-shooter does not make a "FOUR THE MONEY WAGER™" these true odds are not available.

Each "FOUR THE MONEY™" player places their own odds on the designated numbers in front of them. After each roll the dealer will give players ample time to rearrange or take down their true odds to their liking. As true odds are paid there is no house advantage on the odds allowed.

FORTY O'LORDY™

To place an "Forty O'Lordy™" wager, the wager must be bet before the first roll of each shooter. The winning or losing of this wager is based solely on a player's ability to generate 40 rolls prior to a seven appearing. A 4×4 inch electronic light will record the number of rolls made by each shooter prior to a seven appearing.

MATHEMATICAL ANALYSIS OF FORTY O'LORDY

This bet pays off if the shooter rolls a pair of dice forty times without a seven appearing. Players must bet on this feature before each shooter's first roll. The payout for this feature is 1200 for 1. The true odds are 1,468-1, resulting in a house advantage of 18.3%.

OVER SEVEN

All players can bet on this feature prior to any roll. To win, both dice must total 8,9,10,11 or 12. This is a total of fifteen of the thirty-six combinations that can be rolled. The true odds against winning this feature are 7 to 5 the payoff is 6 to 5 leaving the house a 8.4% advantage. There are fifteen winning and twenty-one losing combinations.

UNDER SEVEN

All players can bet on this feature prior to any roll. To win, both dice must total 2,3,4,5 and 6. This is a total of fifteen of the thirty-six combinations that can be rolled. The true odds against wining this feature are 7 to 5 the payoff is 6 to 5 leaving the house a 8.4% advantage. There are fifteen winning and twenty-one losing combinations.

SEVEN

There are six combinations on two dice that will make a seven and thirty that will not Thus the true odds against rolling a seven in any given roll is five to one. This feature pays four to one leaving the house with a 16.67% advantage.

HIGH LOW CRAPS:

In another embodiment, known by the trademark High-Low Craps, disclosed in this specification, a decision event is the completion of four rolls which mandates a decision based on the tally of the numbers shown on the dice. The first terminates each play by a single roller and is based on a specific (four) number of dice rolls. The termination event occurs when the player has bet that the total number value of the dice during the decision is within a first range and the value then falls within a second, different range. An example of this range is above 28, below 28, or equal to 28. An alternative would be to have one range be odd and one range be even as shown in FIG. 8.

A randomizing method is taught. The method involves the use of two sets of dice means (random number generators) in a game with rules to generate a random payout for a video game. The specific technology may be applied to the particular game described above for this purpose.

Improvements disclosed in whole and in part include a game generating one or more random numbers including a means for displaying each of the random numbers generated and may also include a special display for the last of the numbers rolled, and the number of repeated number rolls. Since four rolls are used for a decision event, the video display would show these four rolls.

Under this scenario of the game, there is no limit on the number of points that can be recorded to determine a winning jackpot wager.

It is therefore an object of this invention to provide for a dice game allowing for continuous play centered around adding accumulated points which does not require a repetitive roll of a given number for winning or losing the primary wager.

It is another object of the game to provide for a dice game allowing for true odds to be taken prior to the first roll.

It is another object of the invention to provide a game having added excitement for all players by having payout based on statistically remote outcomes.

It is a further object of the invention to provide for a dice game having a jackpot payout based on a predetermined number of points made during a predetermined period of time.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EMBODIMENT

I. "FOUR THE MONEY WAGER"™ Game

Figure 1:
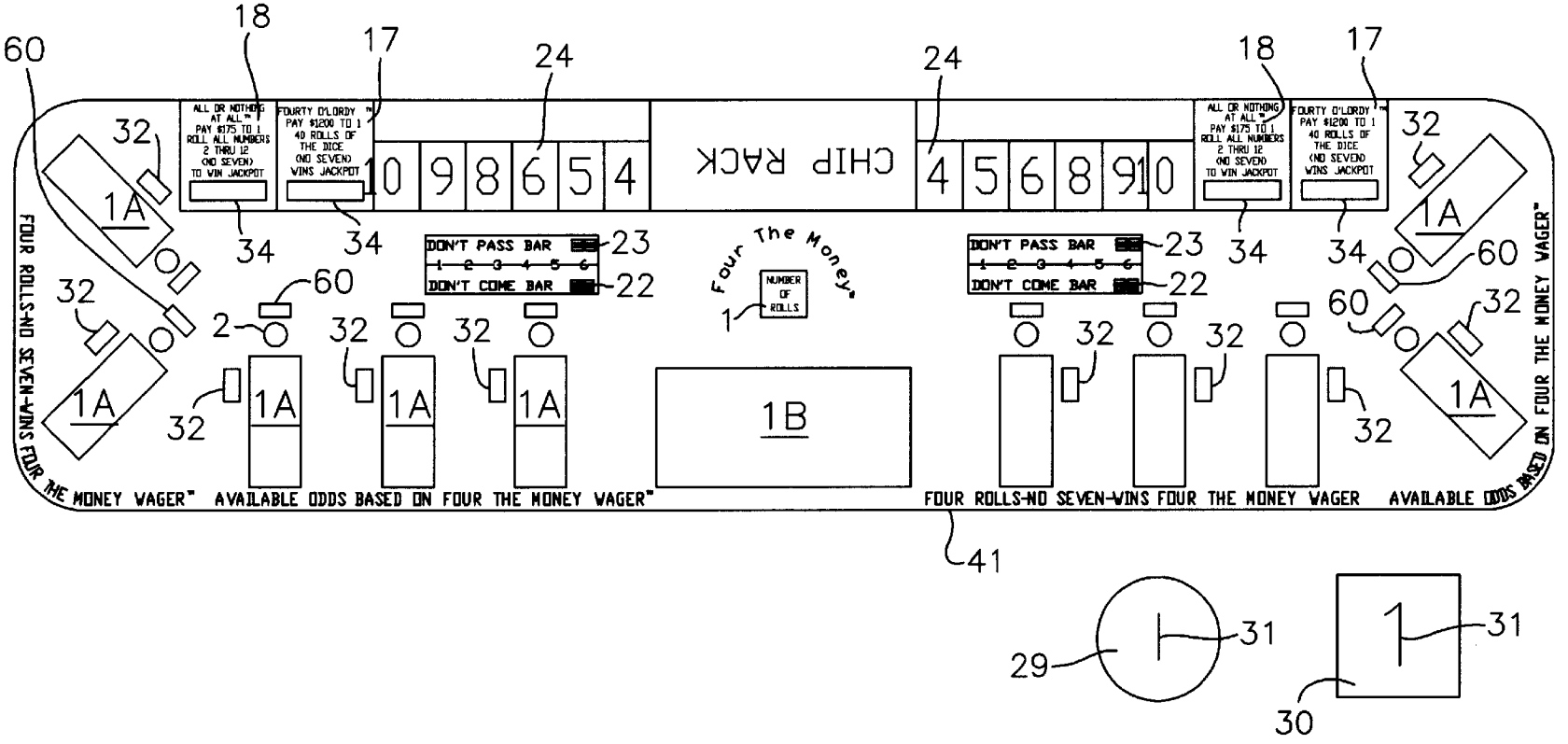
FIG. 1 is a plan view of the invention showing the preferred embodiment of Four The Money.
Figure 1A:
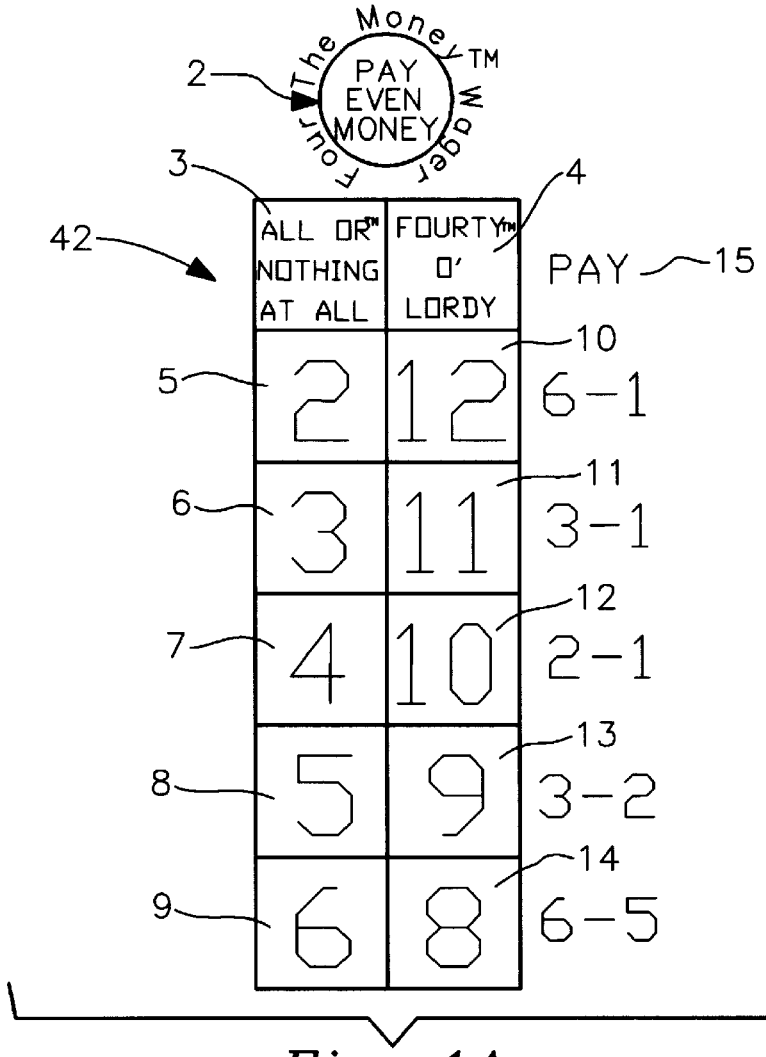
FIG. 1A is a detail of the wagering location designated 1A in FIG. 1.
Figure 1B:
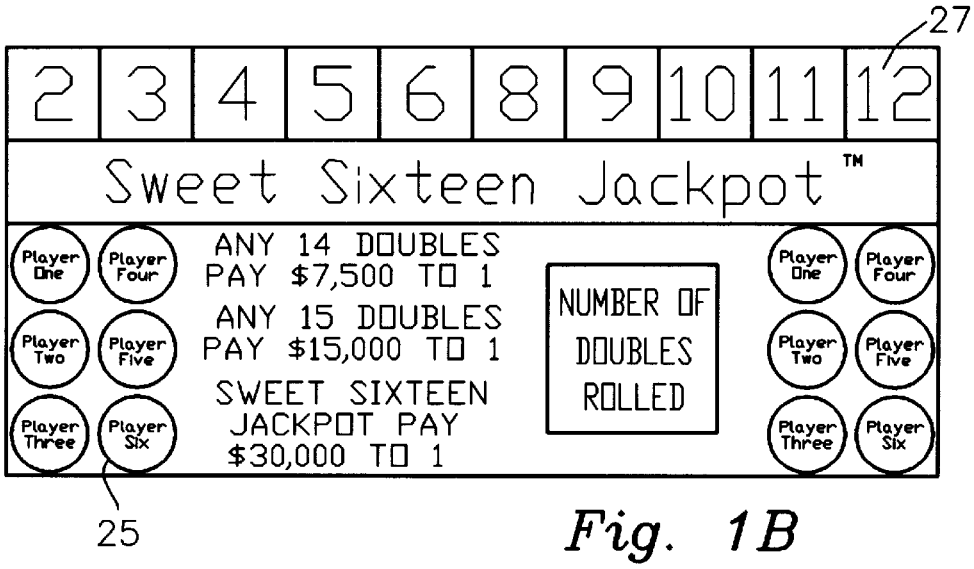
FIG. 1B is a detail of the wagering location designated 1B in FIG. 1.
Figure 2:
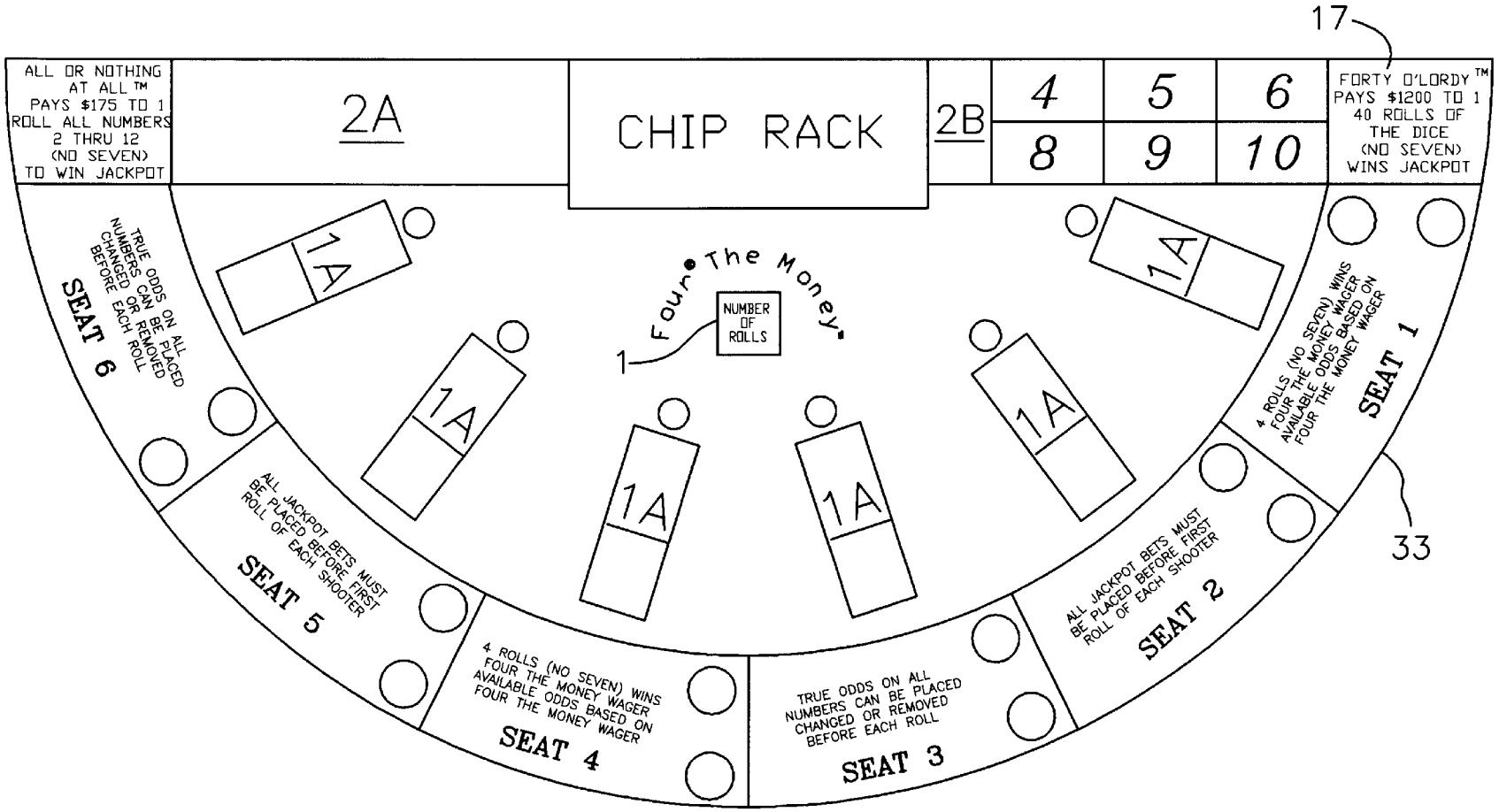
FIG. 2 is an alternate embodiment of the invention shown in FIG. 1.
Figure 2B:
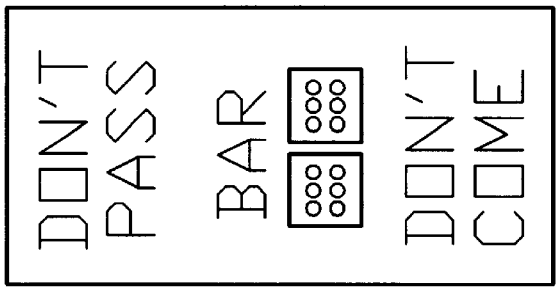
FIG. 2B is a detail of the wagering location designated 2B in FIG. 2.
Figure 2A:
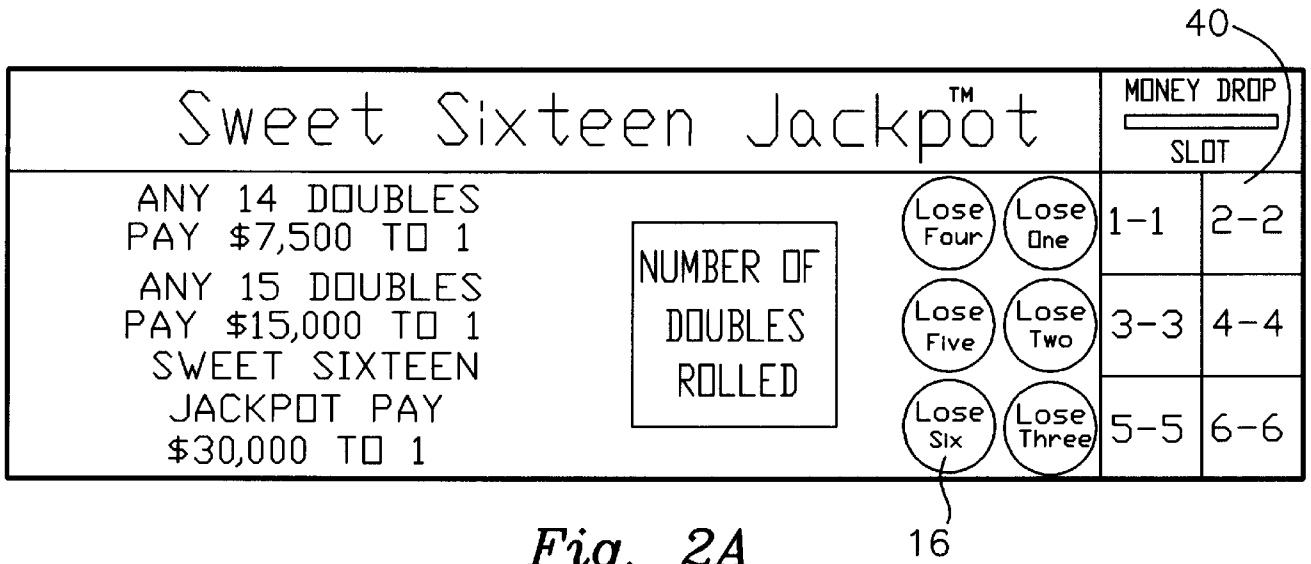
FIG. 2A is a detail of the wagering location designated 2A in FIG. 2.

As can best be seen by reference to FIG. 1 and FIG. 2, the game may be played in a table top version. The preferred embodiment shown in FIG. 3 uses a video layout. Like wager locations on these three embodiments are similarly marked. Play is initiated by generating a random number between a preset minimum and a preset maximum. This is done in the preferred embodiment with traditional two six sided dice analysis. Two random numbers are therefore generated between one and six and totaled to determine the value of the number generated giving rise to various odds based on the percentage possibility of any given combination.

In the preferred embodiment, there is a target number 20 (not shown) selected as the number seven since it is the most likely number. A target of a different number or multiple different numbers, for example six and eight, could also be selected within the disclosure embodied herein. Under such circumstances, the payout odds would need to be modified according to the relative probability of these multiple target numbers being generated prior to the consecutive number described in more detail below being reached.

A money location 2 for a "FOUR THE MONEY WAGER" is provided for the initial even money bet that has to be made to qualify a player to play true odds bets in each new round of the game "FOUR THE MONEY"™. A counter display 1 is provided to show how many consecutive rolls are made prior to encountering the target number 20 (not shown).

The winning or losing of a money wager placed on the money location 2 is based solely on whether or not a seven, the target number, appears within a consecutive number of rolls, in the preferred embodiment four rolls. This determination is not influenced by any other action or bets on the table. A money wager is made on the money location 2, a random number is generated, typically by rolling the dice, and a win occurs if the random number generator or 'shooter' rolls the dice four times, thereby reaching the consecutive number of rolls equal to four, without a seven appearing. If a seven does appear on the 1st, 2nd, 3rd or 4th roll all money wagers made on the money location are lost.

If the shooter rolls the dice all four times without a seven appearing all money wagers made on money locations automatically win.

All other numbers (2,3,4,5,6,8,9,10,11,12) that can appear on a pair of dice, shown as odds bets 3–14 (all numbers except seven), may apply towards the task of making four rolls of the dice without a seven showing. The minimum actual value of a dice roll possible is two. The maximum number possible is 12. Similarly, only some of these numbers may apply to making the consecutive number. For example, 2 and 12 could not be counted in one embodiment in arriving at the consecutive number. The remaining numbers, 3–6 and 8–11, would be the count numbers..

As each successive roll of the dice is made the number displayed on the counter display 1 increases from zero upward. A maximum number of rolls, for example 99, may be assigned in order to avoid a situation where a statistically remote event would otherwise allow for indefinite play. In the preferred embodiment this maximum number is forty. When this maximum consecutive number is reached, all wagers would be paid and the counter 1 would be reset to zero. In the preferred embodiment, the maximum consecutive number would be forty.

A money wager typically would pay even money. The true odds of a seven appearing in four in the preferred embodiment are 1.0736 to 1. The percent of profit to the house under this scenario is 3.55%.

A money wager on the money location 2 is the initial even money bet that has to be made to qualify a player to participate in odds bet.

The winning or losing of this wager is based solely on whether or not a seven appears within four rolls and is not influenced by any other action of bets on the table. To win this wager the shooter rolls the dice four times without a seven appearing. If a seven does appear on the 1st, 2nd, 3rd or 4th roll all "FOUR THE MONEY WAGERS"™ Lose. The wagers placed on the money location 2 are removed and kept for the house. If the shooter rolls the dice all four times without a seven appearing all "FOUR THE MONEY WAGERS"™ automatically win and payout are made on the money location 2.

In the preferred embodiment there is a table which has at least one money wager. In the preferred embodiment a bet is placed on this money location to bet on four rolls in a row. A separate money wager may be provided for bets where it required five rolls in a row in order to win.

It could be determined whether or not a payout would occur on the come out rolls either with the rolling of a seven or eleven or whether there would be no payout on these unless there was a four in a row roll for the four in a row come out bet.

A "FOUR THE MONEY WAGER"™ pays even money. The true odds of a seven appearing in four are 1.0736 to 1. ODDS BETS The game also incorporates true odds bets wherein a bet is placed on a number. These are not standard place bets or odds bets as used in craps based on the statistical significance of a single number being rolled prior to a seven being rolled. One improvement of this game over traditional craps is that odds bets may be made in conjunction with a money wager before a 'point' or number bet is made. This is because repetitions of a single number are not required, only multiple occurrences of any number other than the target number in order to win the initial "FOUR THE MONEY WAGER" on the money location 2.

The odds bets are based on a multiple (1 upward) of the amount placed on the "FOUR THE MONEY WAGER". Hence a table providing for five times odds would allow a twenty five dollar odds wager on an odds location 5–14 where a five dollar wager was made on the money location 2.

This element of uniqueness of this game allows any player to take true odds on all the odds numbers before making their first roll. These true odds bets are made on the odds locations 5–14. If a number other than seven is rolled, the dealer pays out next to the place location corresponding to the number rolled.

The odds are shown in the odds column 15 next to each set of place bets. Hence, if a place bet is made on the place location 5 or 10 corresponding to a dice roll of two (or twelve) and a two (or twelve) is rolled, a payout of six to one is made. That is six dollars would be paid for each one dollar wagered on the two location 5 (or twelve location 10). If a seven is rolled before the rolling of the odds location number 5–14, the odds location wager would be lost and removed by the 'house'.

The odds shown on the pay line 15 are shown on the following table:

| | |
|---|---|
| 2 AND 12 PAY 6 TO 1 | TRUE ODDS 6 TO 1 |
| 3 AND 11 PAY 3 TO 1 | TRUE ODDS 3 TO 1 |
| 4 AND 10 PAY 2 TO 1 | TRUE ODDS 2 TO 1 |
| 5 AND 9 PAY 3 TO 2 | TRUE ODDS 3 TO 2 |
| 6 AND 8 PAY 6 TO 5 | TRUE ODDS 6 TO 5 |

On the table, place locations 5–14 group these numbers together according to the respective odds of making a given bet.

Place bets for the other numbers could also be provided which would play true odds for each of those numbers obtained. This way the subject game could be incorporated completely or in part with a pre-existing craps game.

Forty O'Lordy™

Another feature in the game is the progressive betting associated with successive rolls after the first four without a seven. Successively higher payout or progressive payout may be made as multiples higher than four are made. One method of accomplishing this is to have a payout if forty rolls are encountered without a seven. A Forty wager, in the preferred embodiment, yields a 1200 to one payout as shown in the forty display 17 shown on FIG. 1. Chips indicating how many rolls have been made (one chip for each roll, for example) may be placed on this location to supplement the numeric display 1.

The winning or losing of this Wager is based solely on the number of rolls made prior to a seven appealing. Players may be given a choice of betting on 10, 20, 30 or 40 rolls prior to a seven appearing.

In the preferred embodiment a 4×4" electronic light 1 will record the number of rolls made by each shooter prior to a seven appearing. Another example of how this can be done would be:

| | | |
|---|---|---|
| (1) 10 ROLLS NO SEVEN | PAY 5 FOR 1 | TRUE ODDS 5.9 TO 1 |
| (2) 20 ROLLS NO SEVEN | PAY 30 FOR 1 | TRUE ODDS 37.3 TO 1 |
| (3) 30 ROLLS NO SEVEN | PAY 200 FOR 1 | TRUE ODDS 236.3 TO 1 |

-continued

| | | |
|---|---|---|
| (4) 40 ROLLS NO SEVEN | PAY 1200 FOR 1 | TRUE ODDS 1468 TO 1 |

Obviously, this can also be done in multiples of 1, 2, 3, 4, etc. without departing from the inventive concept herein. These exemplary methods are shown for purposes of teaching the invention embodied herein.

Similarly, successively larger pay outs on money wagers may be placed at successive rolls to build excitement. For example, after ten rolls, each for the money payout may payout at a higher yield, such as 1.5 to one. In this example, at 12 rolls, instead of a dollar for dollar payout there would be a dollar and fifty cents for each dollar on the money location 2. This could hold for all the following "FOUR THE MONEY WAGERS" or terminate or increase again. This would prevent players from coming in except on the don't pass after the first four rolls, however, and is not shown on the preferred embodiment.

Similarly, this particular provision could be allowed only with the payment of a successive wager accepted at the beginning of each roll. In this manner, at the beginning of each round (after a target seven was generated are the first time the game is played) a player would place a successive wager. This successive wager could entitle the player to jackpots or to the successively higher pay outs. Other players joining in later in the roll could not participate in the successively higher payout.

One method of practicing a jackpot or successive wager proposition only available on the initiation of a game would be to provide a slot 32 for payment beside a particular player's for the money wager. If a payment was made into this slot prior to the initial roll, a light could be displayed under the money location 2 (or at any other suitable location) showing this player was entitled to either jackpots, successively higher pay outs or both. One jackpot wager slot could be provided for the jackpot and a second successive wager slot could be provided for successively higher pay outs. At least one slot 32 on a table top version is provided for each player location 33. A jackpot display 34 may be placed at any location on or above the table for any of the jackpots described herein.

DON'T COME DON'T PASS BETS

Don't pass bet locations 23 and don't come bet locations 22 are provided for two purposes. First, it allows players to come into the table after the initial "FOUR THE MONEY WAGER" is made where multiple rolls provide enhanced payout. Second, it allows system players to play system bets. A tracking location 24 is provided in order to allow for the player's bets to be held by the house and paid according to generally accepted gambling practices.

These bets work in the same fashion that don't come and don't pass bets work with traditional craps.

As can be seen the don't bet tracking location 24 is numbered from 4 to 6 and 8 to 10. This is because all other traditional don't pass bets are either losers, ties or winners.

The odds may be the same on don't come, can't pass bets as are provided on odds bets on the odds locations 5–14 on the money wager made on the money location 2.

HIGH ROLLER OF THE MONTH

To practice High Roller of the Month on a traditional craps table the modifications necessary would be to predetermine the number of rolls necessary to win prior to the termination event of a roll (known in the art as "seven out") and provide a counter and a payout based on dice rolls for qualifiers.

1) An electronic keyboard and a counter 1 in FIGS. 1 and 2 would be added to monitor the number of points or rolls. With each participating shooter, the box man will activate system. If a shooter chooses not to participate, the box man does not activate keyboard. Each time the keyboard is activated, money is added to the jackpot.

This is a jackpot which in the preferred embodiment is paid monthly, but may be paid weekly, yearly, etc. Similarly, several tables or even different casinos may be tied in together to increase the jackpot. In the monthly embodiment, the jackpot begins the first minute of the first day and ends on the last minute of the last day of each month.

To participate,

1) The Shooter pays one dollar, which is added to jackpot.
2) If shooter chooses not to participate, keyboard does not activate the counter.
3) The qualifying score must be recorded in shooter's name.
4) Multiple crap tables within each casino can be tied together with one mutual jackpot.
5) No matter when a shooter qualifies, they participate in all monies accumulated during month.
6) A qualifying event may be necessary to qualify as a winner:

At a four the money table, a shooter may have to hit a certain number of cycles in the preferred embodiment. In the preferred embodiment, the shooter must make forty points on a traditional craps table to qualify. A payout based on the Forty O'Lordy wager discussed herein may be tied to this achievement. On a traditional craps table, this 40 rolls would be the scoring of 40 points in the preferred embodiment and would include 7's rolled on the 'come out' roll.

An alternative would be to have the qualifiers roll a certain total tally over the course of a standard craps roll. For example, rolling a six, an eight, a six, a seven, a five and a seven would yield a total tally of either 32 or 39 depending on whether the last seven were counted or not. A tally of 300 points is set in the preferred embodiment. A jackpot similar to the Forty O'Lordy jackpot in amount, based on the odds of reaching this number would be paid upon reaching this tally.

7) All qualifying shooters are winners.
8) Names and score of all qualifying participants may posted with casino.
9) The leader's name and score may be individualized.
10) If no shooters qualify, jackpot may be rolled over to the next month.
11) A person's name and score can be registered only once. If a shooter exceeds their previous qualifying score, only the highest qualifying score is valid.
12) In one embodiment 100% of all money accumulated goes into the jackpot. In another embodiment, a percentage of this payment goes to fund the Forty O'Lordy wager.
13) Each month's contest begins at 12:01 on the first day of each month and ends at midnight on the last day of each month.

An alternative embodiment would provide that any people at the table could wager on any Shooter's roll. The jackpot would then be split between the players who wagered on the particular Shooter's roll. This would function in the same way as the shooter's wager but would allow other players to participate in a high roller's shot at a jackpot. This would encourage friends to wager on another friend's high roller wager. A high wager location 60 for the high roller wager is provided in FIG. 1.

In this, Four the Money embodiment, there could be a playoff or roll off for all rollers who scored 40 or more rolls and decided to participate in the playoff for the jackpot.

In another embodiment, there would be pay outs to all qualifier or at least the top three. One method of this division would be:

30% bonus to 1st place winner
20% bonus to 2nd place winner
10% bonus to 3rd place winner The balance of money could be equally divided between all qualifying shooters, including the first, second and third place winners.

In order to compensate casinos for cost of operation, it might be determined a certain percentage of jackpot money might go toward that cost.

This is discussed in more detail below.

High Low Craps

Figure 5:
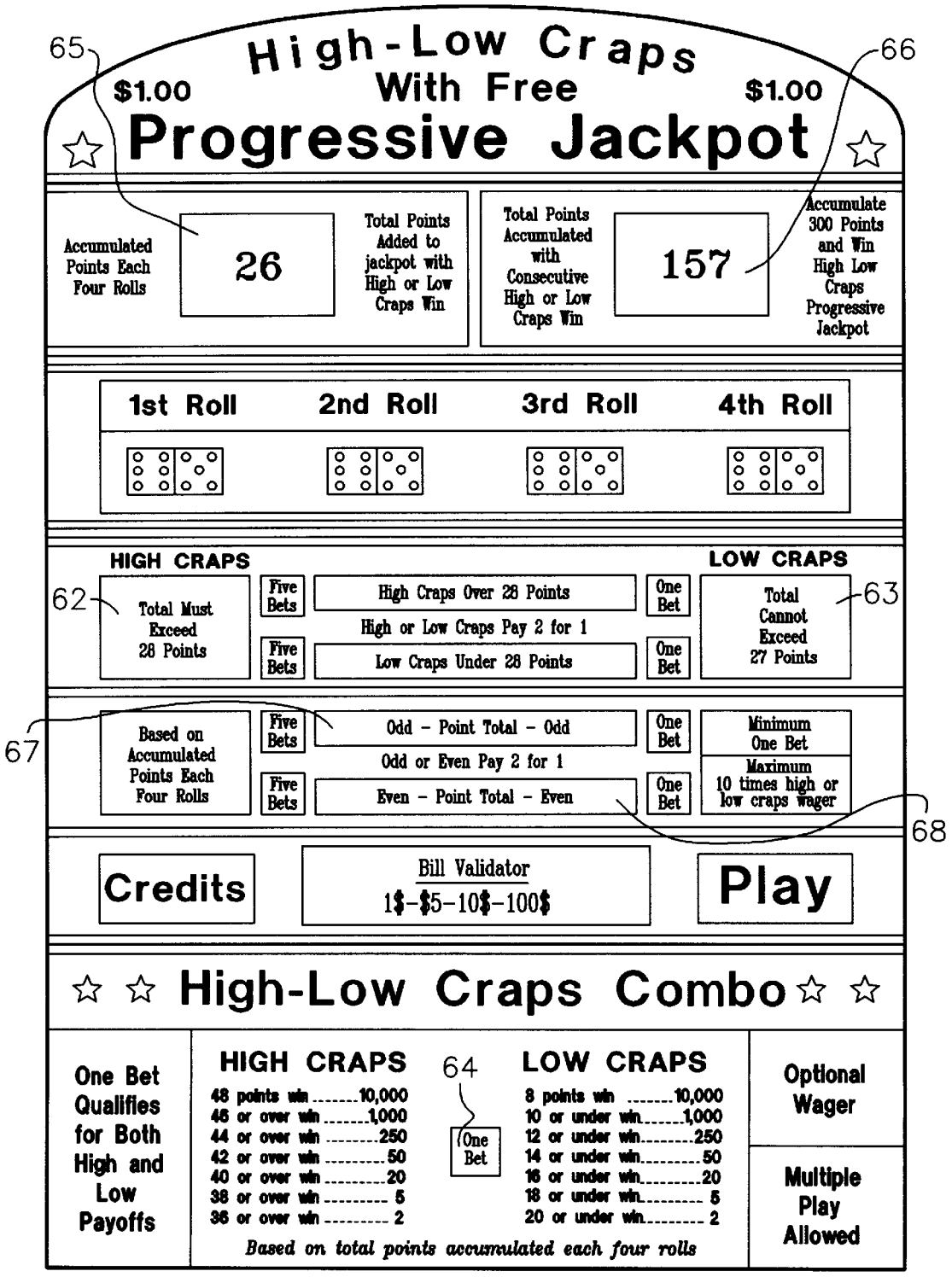
FIG. 5 is an embodiment of the video layout of High-Low Craps

This game is preferably played with two six-sided dice. A video version of this game is shown in FIG. 5. The only difference between the video version and the table top version would be a wager location for the different wagers shown for each separate player. There are no naturals, no craps, nor is the repeat of numbers involved in determining a decision. The entire thrust of this game is based solely on adding the actual numbers rolled in a predetermined number of rolls.

There are 36 different combinations that can be rolled with two six-sided dice. The average number of points that appear in each roll is seven. This is determined by dividing the 252 total points that appear by the 36 different combinations.

In order for any gaming device to be deemed practical, a house advantage is required. It is built into this game by stipulating if the total number of points rolled in a predetermined number of rolls, add up to a preselected number, all wagers lose. As seven is the average number of points that appear in each roll, it is multiplied by the number of rolls required in determining a decision to arrive at that preselected number.

Before the first of the required number of rolls is made that determines a decision, participants have the option of wagering on either high or low craps. The following is based on a decision rendered each four rolls of the dice. When multiplying the seven points per roll average by the four rolls that determine a decision, 28 becomes the number used to divide high from low craps.

High Craps

A wager may be made at the high craps location 62. To win this wager the total number of points appearing with four rolls of the dice must exceed 28 points.

Low Craps

A wager may be made at the low craps location 63. To win this wager the total number of points appearing with four rolls of the dice cannot exceed 28 points.

House Advantage

Occurs when the total number of points appearing with four rolls of the dice total exactly 28 points.

High-Low Craps Combo

This feature offers a payoff on two opposite functions, rolling all high numbers or rolling all low numbers. This feature requires only one bet to qualify a bettor for both the high and the low scheduled payoffs. This wager is made at the combo location 64.

Wagering on this feature is designed to maintain participants' interest and create excitement with every roll of the dice required in reaching a decision. Its structure will accomplish this goal by allowing a bettor to participate with both the high and the low craps payoff with only one bet.

Monitor and Display

A portable electronic brass urn may be attached to each table for monitoring and displaying purposes. Its function is two-fold: display the last number rolled while adding the number of points that appear with each roll. This display would merely take the numbers shown on the video version shown in FIG. 3 and place those numbers as they are generated in the table top version. Similarly, the electronic displays on the other tables disclosed herein could be consolidated at a single location.

High-Low Craps Combo

Figure 8:
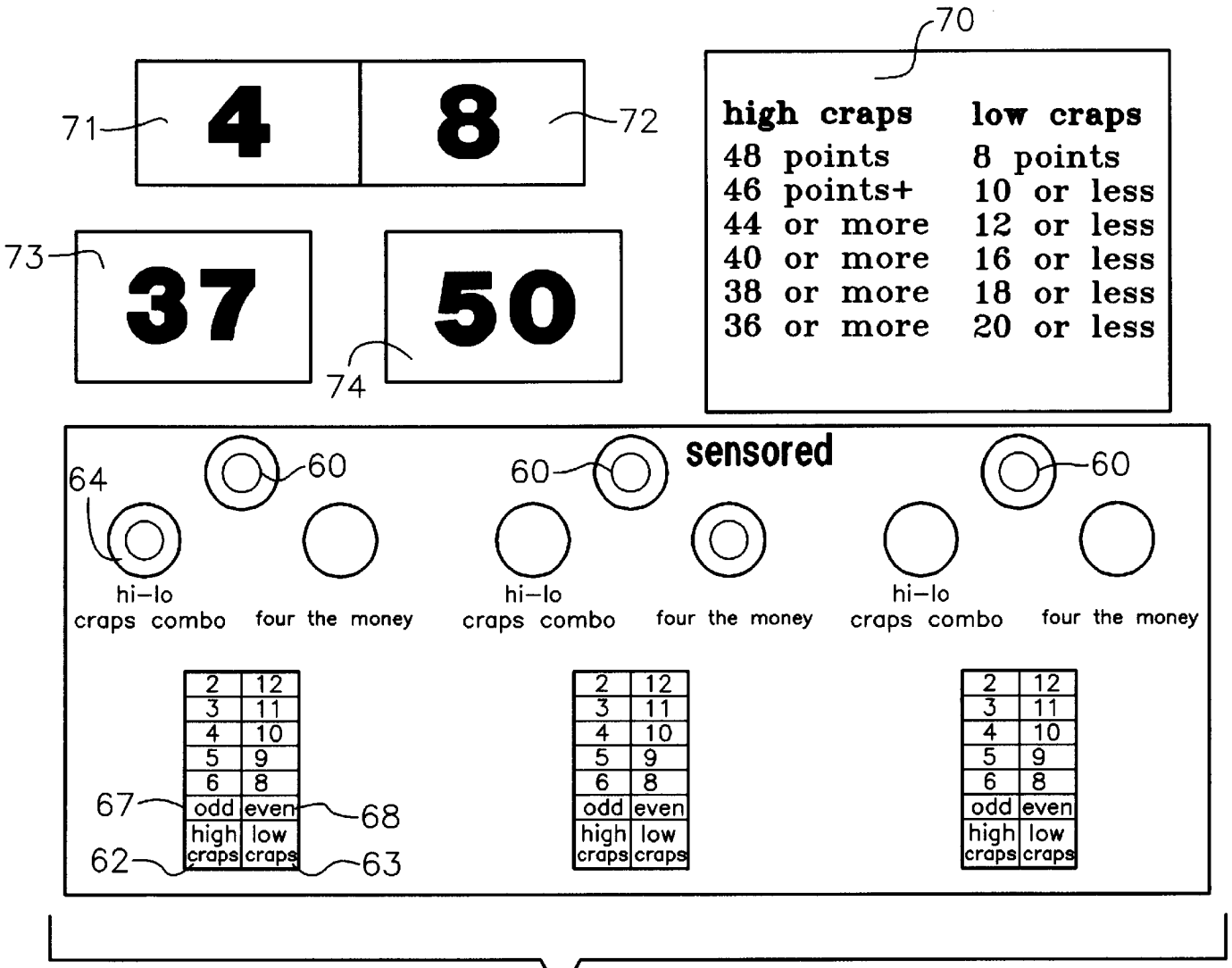
FIG. 8 is an alternate embodiment of the game of FIG. 3 in a table top version.

Referring to FIG. 8, the odds wagers may be shown on a wager display 70. A Four The Money decision display 71 shows the number of rolls (14). A total rolls display 72 shows a roller's entire roll. A tally decision display 73 shows the total of the four rolls (here 37). A tally total display 74 shows a tally of all the rolls. This type of layout provides for a table top game or a video game having multiple users.

A location for a combo wager 64 is provided providing enhanced odds and giving a player who fails to make a high or low craps win a second opportunity to win. The odds are shown in the chart 70.

| High Craps | Low Craps |
|---|---|
| 48 points win 10,000 | 8 points win 10,000 |
| 46 or over win 1,000 | 10 or under win 1,000 |
| 44 or over win 250 | 12 or under win 250 |
| 42 or over win 50 | 14 or under win 50 |
| 40 or over win 20 | 16 or under win 20 |
| 38 or over win 5 | 18 or under win 5 |
| 36 or over win 2 | 20 or under win 2 |

This wager 64 is based on total points accumulated each four rolls. 1) The high craps wager pays when the actual value of the dice rolls over a series of four dice rolls averages nine or more per roll for a total of thirty-six or more. 2) The low craps wager pays when the actual value of the dice rolls over a series of four dice rolls averages five or less per roll or less for a total of twenty or less.

This feature requires an additional wager be made at the combination location 64. The only function of this feature is to offer a multiple type payoff that ranges from a small to an extremely large payoff. This feature is designed to blend with both a high or low craps wager as each four rolls of the dice constitute a decision on this feature also.

Accumulated Points

Accumulated points are shown at the accumulated display 65. This feature is designed to add the numbers rolled on both dice for each of the four rolls required to constitute a decision. After each four roll decision is totaled the function of this feature is terminated.

Consecutive Accumulated Points

This feature is designed to track the points accumulated with every consecutive win of a high or low craps wager. Consecutive location 66 displays this amount. Once a participant does lose their high or low craps wager it terminates the count. To win this feature a participant must acquire a pre-determined number of points. These points are accumulated with consecutive wins of a high or low craps wager. This feature will zero out the count with a loss of a high or low craps wager.

There are two termination events. The first is a set termination event which terminates each play by a single roller and is based a specific (four) number of dice rolls. The second is an accumulated termination event which terminates a players series of rolls which occurs when the player has bet that the total value of the dice rolls is within a first range and the value then falls within a second, different range. Examples of these ranges are, odd numbers, even numbers, above 28, below 28 or equal to 28. The preferred embodiment of this game, set forth above uses above 28 and below 28 as termination events.

To qualify as a shooter, a participant must place a wager on high or low craps. The winning or losing of this preferred embodiment is determined by totaling the number of points that appear in a predetermined number of rolls. The minimum number of points required to win a high or low craps wager is determined by multiplying the seven average number of points that appear with each roll by the predetermined number of rolls.

To win a high craps wager, a shooter must exceed this average whereas to win a low craps wager, the total number of points accumulated must be less than that average number. A house advantage is built in this preferred embodiment by declaring both high and low craps wagers lose if the total points accumulated add up to the exact mathematical average.

An example of this, is requiring four rolls of the dice to determine a decision. When multiplying the seven average number of points that appear with each roll by the required four rolls, 28 points is the average number of points that appear with four rolls. A house advantage is built in by declaring both high and low craps wagers lose if the total number of points that appear with four rolls of the dice total exactly 28 points. Winning wagers on this preferred embodiment pay even money and determine if a participant continues on as the shooter. Wagers on this preferred embodiment are also the criteria that qualifies a bettor to wager on either the odd or even embodiment prior to any roll of the dice.

The random number generator in the above example is a set of dice. This game in an alternate embodiment uses cards to generate numbers, even though two cards need not be added to get the second number. In cards, a set of at least three cards (e.g. 2,3,2) could be added to get the result (here 7) to give a jackpot. In this example three aces could be the lowest three card hand and three tens might be the highest hand.

ODD OR EVEN

With conventional craps, the multiple of odds allowed are based on a pass or don't pass wager. With this invention, the wagering on odd, at the odd location 67, or even, at the even location 68, prior to any desired roll serves as a replacement. The multiples allowed each time are determined by the casino host and may vary from casino to casino. Because there is no house advantage with this embodiment, the criteria for allowing bets on this feature is based on a high or low craps wager. Since an odd or even decision is determined every roll of the dice, the number of different times a participant can bet on this feature is based on the number of rolls required to win a high or low craps wager.

HIGH-LOW CRAPS COMBO

Winning or losing of this optional feature is determined by the final number of points rolled in a predetermined number of rolls. Whereas the winning or losing of a high or low craps wager has a single target number with an even money payoff. This feature offers a multiple type payoff based on a shooter's ability to roll the high maximum or low minimum number of points that can be rolled in a predetermined number of rolls. The closer to the maximum or the minimum number of points possible, the higher the payoff.

The maximum number of points that can be rolled with four rolls of the dice is 48, while the minimum number is 8. The payoff structure for this feature is based on the mathematical odds of how close a shooter comes to the ultimate high or minimum low number of points that reward a payoff.

Based on four rolls of the dice, a high craps payoff could range from 36 to 48 points While the low craps payoff could range from 8 to 20 points.

Because one bet on this feature does qualify a participant for both the high and the low craps payoff, this composite feature maintains interest of all participants throughout the predetermined number of rolls required in determining a decision.

VIDEO SLOT FUNCTIONS

1) Screen displays four rolls 101–104 of the dice, one at a time.

2) Decision display, here accumulated display 65 is capable of adding the number of points that appear with each of the allotted four rolls.

3) Total accumulated point display 66 to show the total number of points that appear prior to the termination event.

Once a participant loses their High or Low Craps wager, the total accumulated display 66 goes to zero (0). The total accumulated display 66 is for the purpose of offering a jackpot payoff. Single player version can offer a jackpot payoff when a predetermined number of points are accumulated with consecutive high or low craps win. Each multiple player game can offer a progressive jackpot based on its percentage of play. Participants must choose either high or low craps, they cannot play both. Both single and multiple player jackpots are free as all four features of game have built in vigorish, or house advantage. An example of a single player jackpot pay off would be when the player accumulated 300 points for a pre-determined payoff. An example of a multiple player progressive jackpot would be when the player accumulated 500 points and would then win that table's progressive jackpot. A base jackpot payoff on 28 being the average number of points that appear with four rolls of the dice. Another option would allow a tie to cancel out the accumulated points on the jackpot feature, another option would not.

High Roller of the Month

How to Play

This feature is designed to offer two different payoffs with only one function. Reward all bettors with a large immediate payoff while qualifying the shooter as a high roller of the month jackpot winner. All qualifying shooters will share in this monthly progressive jackpot.

Each monthly contest begins on the first minute of the first day of each day of each month and ends on the last minute of the last day of each month. The winning or losing of this feature is based solely on adding the actual numbers rolled during each participating shooter's turn. Both the immediate and jackpot payoff are determined by adding the actual numbers that appear on two six-sided dice prior to seven out.

To win, a shooter must accumulate 300 points or more. When a shooter does seven out, those seven points are not added to the total. The shooter does not have to bet this feature in order to qualify.

To qualify a shooter as a High Roller of the Month winner, a total of $5.00 or more must be bet on this feature. It makes no difference if the shooter bets it or not, as long as the total bets equal or exceed the $5.00 required to qualify. Additional money is added to the jackpot with each participating shooter.

Jackpot Payoff

1st place receives 20%

2nd place receives 15%

3rd place receives 10%

4th place receives 5%

The remaining 50% will be divided equally between all qualifiers, including 1st, 2nd, 3rd, and 4th place winners.

The jackpot payoff feature is adaptable with this invention as a table game, a video (slot) game, or can be an added feature with the rules of play of conventional craps. To win, a shooter must accumulate a predetermined number of points based on the rules of play of each different type of game.

This invention is designed to offer a large immediate payoff to all bettors and/or qualify the shooter as a High Roller of the Month jackpot winner. All qualifying shooters will be eligible to share in this monthly progressive jackpot.

Each monthly contest begins on the first minute of the first day of each month and ends on the last minute of the last day of each month. The winning or losing of this feature is based solely on adding the actual numbers rolled during each participating shooter's turn. Both the immediate and High Roller of the Month payoffs are determined by adding the actual numbers that appear on two six-sided dice bearing numbers 1 through 6. The requirements may vary with different versions of this invention and will be determined by each different version having different rules of play within this context.

VIDEO (SLOT) GAME

A video (slot) version of this invention is envisioned displaying four different rolls of tow six-sided dice bearing numbers 1 through 6. Those four rolls will constitute a decision on a high or low craps wager, which are the preferred embodiments of this invention. The number of points rolled with each four different rolls will be electronically totaled and determine the winning or losing of a high or low craps wager.

A jackpot based on a predetermined number of points being accumulated will be established with a target number that can be reached with consecutive high or low craps wins. A special screen will add and display the number of consecutive accumulated points.

DISPLAY AND MONITORING

During the play of a manually controlled dice game, tracing the number of points necessary to win can best be done by the use of electronic methods. The device used must have the ability to add the accumulated points as well as display the total count of each participating shooter. To register the number of points accumulated with each roll, there are 11 buttons bearing the numbers 2 through 12. The appropriate button punched by the casino host will monitor and display the count of accumulated points.

This device will also have the ability to add additional money to a progressive type jackpot that is based on a predetermined time period. When this jackpot feature is made a part of a conventional played dice game and a seven out is rolled, those seven points will not be added to the total count.

METHOD OF GENERATING RANDOM PAY OUTS

Figure 3:
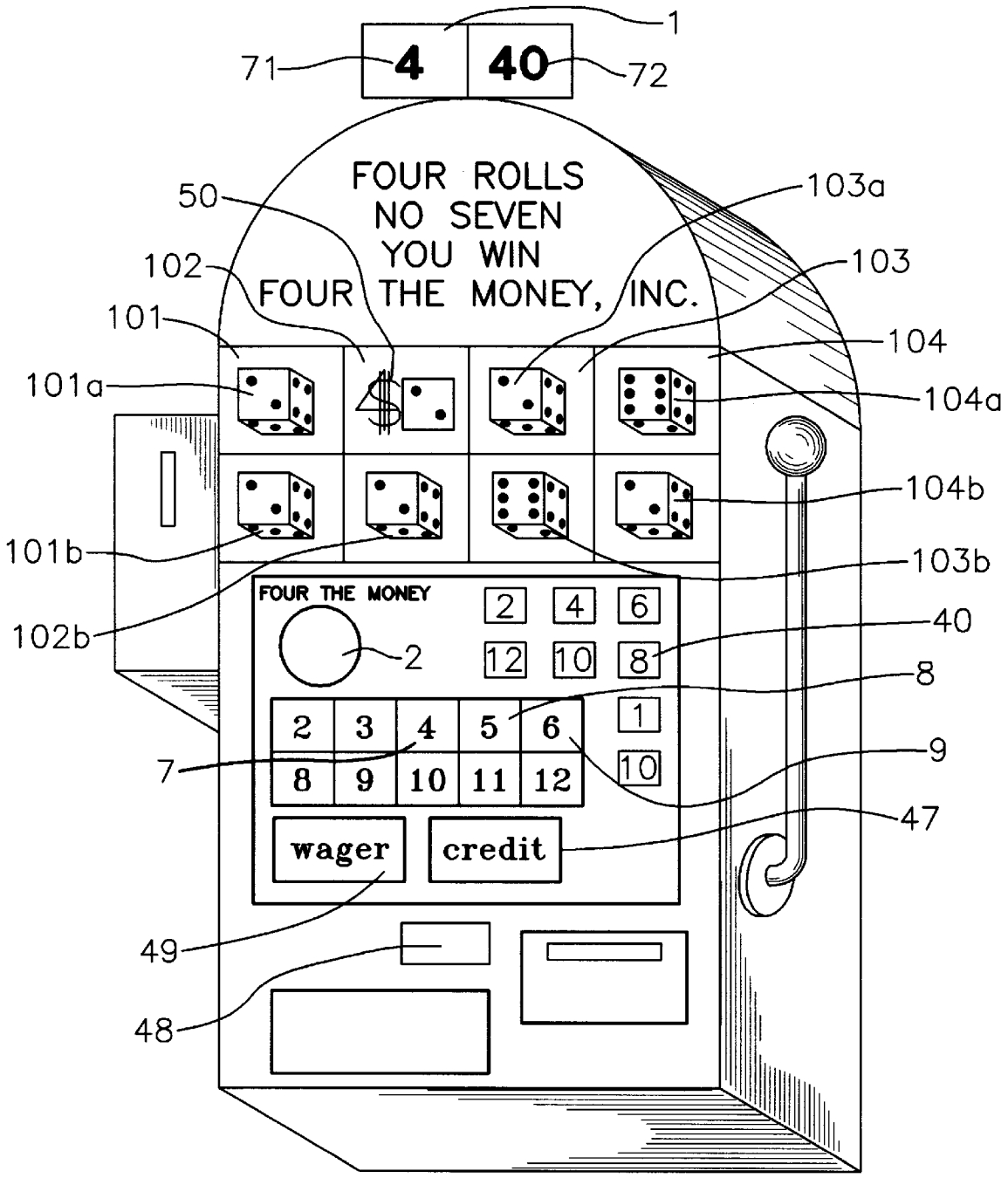
FIG. 3 is a video layout for practice of the same.

A randomizing method for Casino Video and Slot Games is taught or shown in FIGS. 3 and 5.

The first randomizing method is broad and involves the use of at least one, but usually two sets of dice means (random number generators) in a game with rules to generate a random payout for a video game. The display may include three (3) rolls of two (2) dice of these double displays as shown in FIGS. 3, 5, 6, 6A and 7. This specific game while similar to the table top version has important differences.

Figure 6:
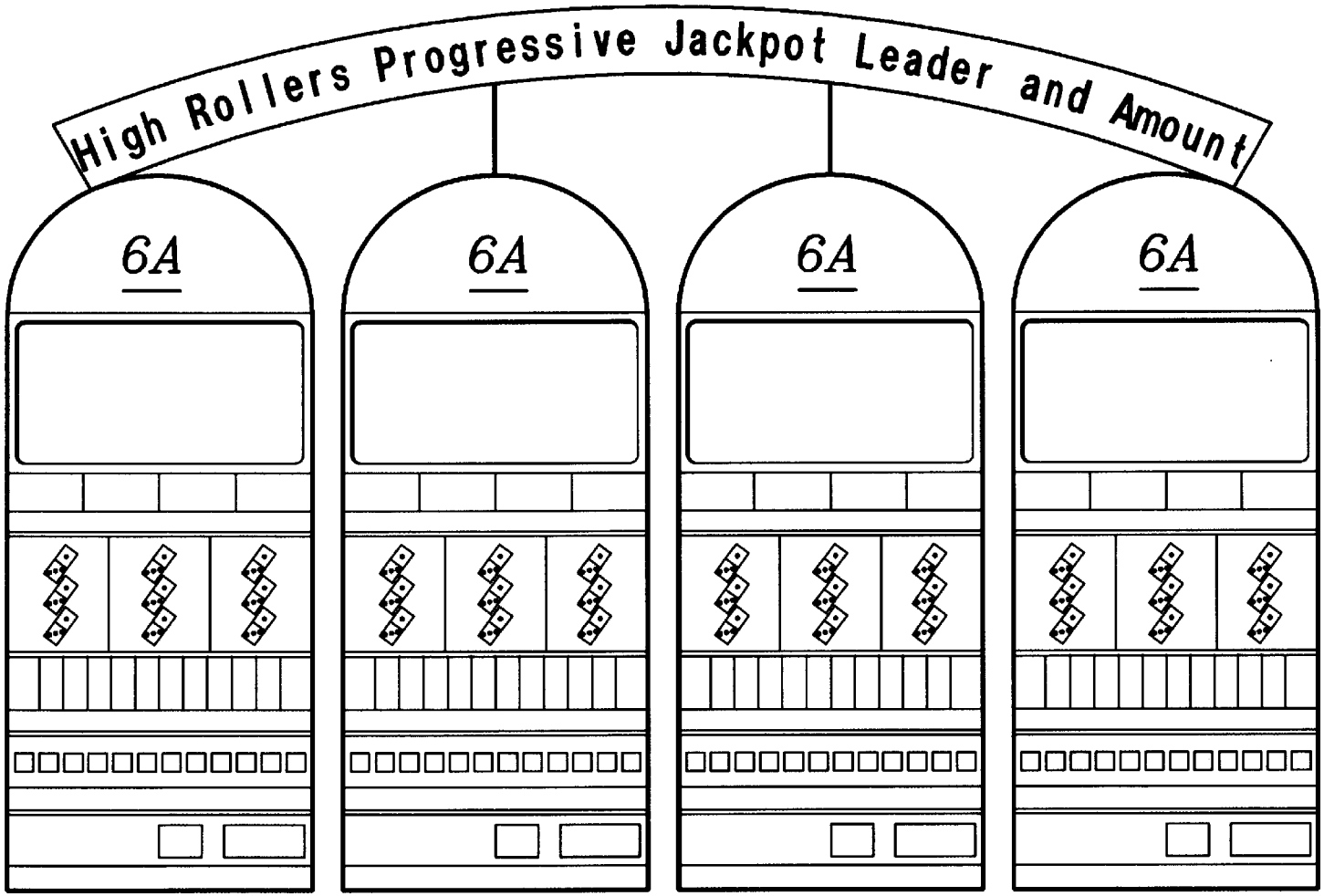
FIG. 6 is an alternate embodiment of the video incorporating the High Roller of the Month feature.
Figure 6A:
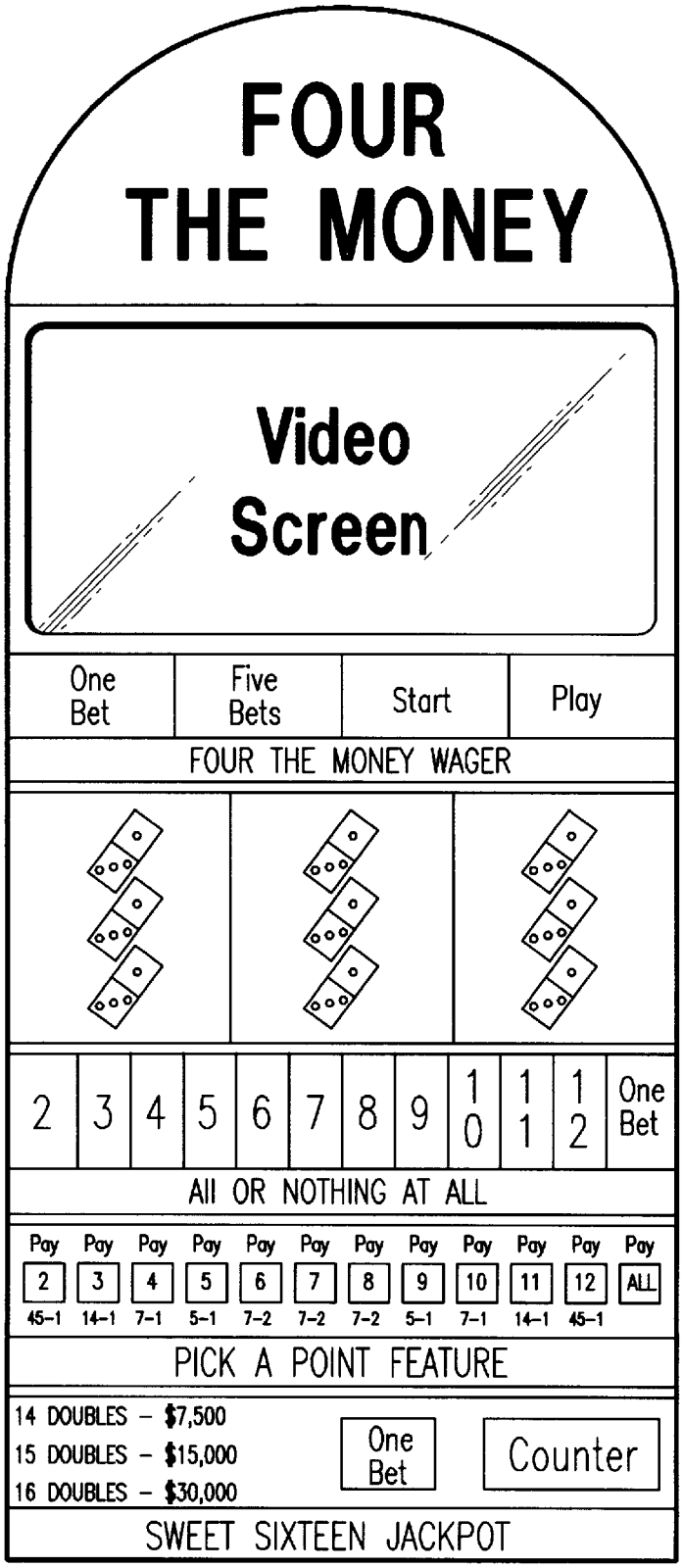
FIG. 6A is a detail of the wagering locations in FIG. 6.
Figure 7:
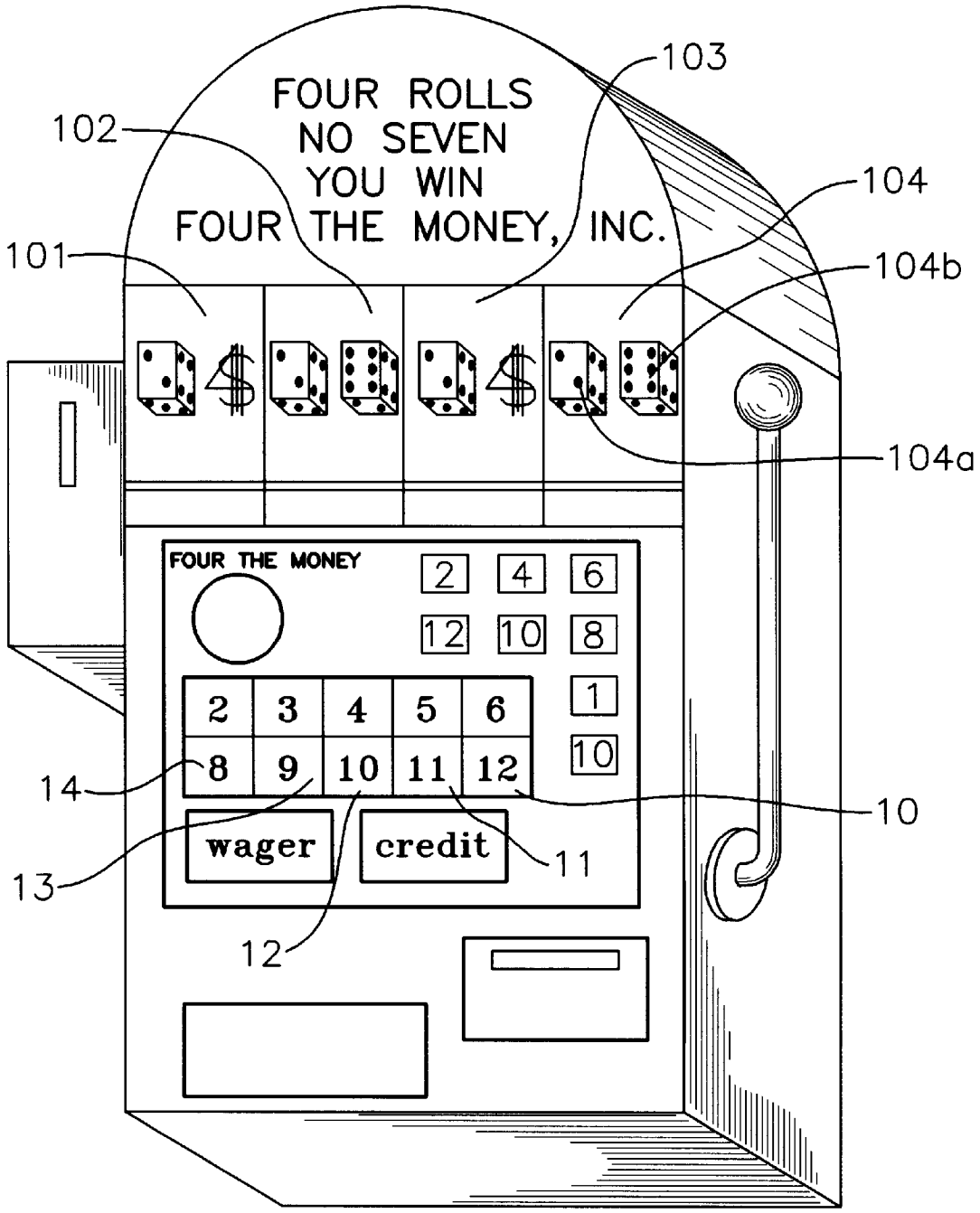
FIG. 7 is an alternate embodiment of the video lay of FIG. 3.

FIG. 6A shows three different sets of rolls 101–103. Each of these sets has three different sets of dice 108, 109 and 110. FIG. 7, on the other hand, has four different sets of rolls 101–104, each having one set of two dice rolls each, for example roll 104 is comprised of dice 104*a* and dice 104*b*.

The technology may be shown by exemplary disclosure set forth below.

A display for this method of playing a betting game using multiple random number generation having a set event which terminates the multiple number generation comprises the steps of:

a) providing at least three columns for viewing;

b) displaying at least two random numbers, being a first and second random number, generated in each of the at least three columns;

c) providing a payout based on the combination of the total of the two random numbers displayed in each of the three columns;

d) providing a payout based on the comparison of each of the columns to the adjoining column;

e) providing a payout based on the comparison of each of the first random numbers to the corresponding first random numbers generated in the adjoining column;

f) providing a payout based on the comparison of each of the second random numbers to the corresponding second random numbers generated in the adjoining column.

In addition to these specific functional formats, a method of generating a randomized result in a video or slot machine type game is disclosed. First, a game with rules must be devised which has a set termination event. The best examples are a set number of rolls (4 in the high low craps embodiment set forth above) or upon reaching at least one target number (such as the generation of a seven in the example for four the money) which presets the maximum number of runs with a payout possible on at least one of the multiple number of runs. The game may have a specific number of runs, with a payout possible for each roll (such as 40 rolls in the four the money preferred embodiment) or may have the number of runs limited only by statistics.

In one embodiment, this result generated would be defined by the following steps:

a) choosing a minimum number;

b) choosing a maximum number;

c) choosing at least one termination event in the preferred embodiment generating at least one target number between the predetermined minimum and the predetermined maximum;

d) choosing at least one consecutive number;

e) generating at least one random number in response to the application of credit to the game between the predetermined minimum and the predetermined maximum;

f) repeating step (e) and maintaining a count on the number of repetitions of the recurrence of at least one count number, other than the target number, between the predetermined minimum and predetermined maximum until the at least one consecutive number comprising a predetermined number of consecutive recurrence of at least one count number between the predetermined minimum and predetermined maximum other than the target number is reached or the at least one target number is generated.

In this way, a payout may be established when the number of repetitions reaches a first preset maximum number. Similarly, the number of repetitions may automatically terminate when the first preset maximum number is reached or when a second preset number is reached.

In the preferred embodiment, individual wagers are possible. These may be automated in response to a token or credit being deposited or may be through the selection (as by touching a touch screen position, moving a mouse or other pointer to a specific location and selecting the location, keyboard input, etc) of a specific wager. This step may be described as:

(g) placing an odds wager on an odds bet number between the minimum number and the maximum number on the probability that the odds bet number will be generated prior to the at least one target number being generated.

Utilizing this method of wagering in the foreground or the background a video game or payout on a slot machine may be calculated.

To perform this calculation of a payout, the following steps would need to be added:

(h) Calculating the payout on the odds wagers with or without an additional payout on the probability of a consecutive series of rolls being made prior to the target number being generated;

(I) Giving a credit equal to the payout calculated in step (g);

(j) repeating the steps a–I until the preset maximum is reached for terminating the game or until the target number is reached.

The technology submitted may be run in the foreground as a screen game or in the background as a means of generating a randomized result and randomized payout. If run in the foreground, a single roll or all of the rolls may be displayed with or without the payout associated with each roll and information on how that payout was generated.

This means that the game may use a single coin to generate a result or may be used to have individualized wagers made on the table.

To further explain, the following examples are illustrative.

The player plays one or more credits. Credits may be in the form of tokens or coins applied or electronically maintained numeric credits.

For each credit (or set of credits) an entire game is run in the background until either of two results occurs:

(1) the target number is reached or (2) a predetermined number of consecutive recurrence of at least one count number between the predetermined minimum and predetermined maximum other than the target number is generated.

At this time, a payout is made to the player. For example, using a randomizer to generate results for two six sided dice, numbered 1–6 sequentially, and a target number of 7, a payout of one credit could be made if 4 consecutive numbers were generated prior to the generation of a 7. This amount would be doubled if two sets of 4 consecutive numbers were generated prior to the generation of a seven, tripled for 3 consecutive sets of 4 numbers, etc, up to a predetermined maximum.

If the technology set forth in step g of claim 3 above were utilized, then the credits applied to the game could be split (1) automatically or (2) by election of the player of the game to place certain wagers on 'odds' bets. Preferably, the payout on these wagers would be 'true odds'.

Examples of this automated technology using the dice example set forth above would be:

1) the credit could be divided between odds wagers.

Examples:

(a) one credit could be played (b) the game would internally divide the credit played between the odds bets (c) (I) with or (ii) without a portion of the credit being applied to the odds of a consecutive number of counts being generated before the target number is generated.

(d) the split between odds could be split equally or unequally between selected odds bets [e.g. ⅕ credit on the consecutive count bet set forth in (C), and 2 times on 6 & 2 times on 8- equal to double odds) or could be equally or unequally split between all of the odds (e.g. no credit on the consecutive count wager and 1/10th on the 6& 1/5th on the 8, 2 times on the 4, 1/10th on the 10 and 1/5th on the 9.]

(e) Similarly, this split between odds could be randomized so that a percentage of the credit was randomly assigned between the different odds wagers.

2) the number of odds wagers could increase with the number of credits played.

For example, the first credit could go to the wager that a predetermined number of consecutive recurrence of at least one count number between the predetermined minimum and predetermined maximum other than the target number is reached (four using the two six sided dice); the next credit might put an odds wager on the six, the next a second odds wager on the six or a separate wager on the 8, etc.) This division could be (1) randomly assigned or (2) be assigned by direction of the player or (3) could be assigned by pre-programmed directions.

3) the numbers of sides of dice used could be increased or decreased depending on the number of credits played;

This very complex arrangement would vary the odds and payout by changing the numbers of sides of the dice used depending on the amount of credit paid.

As can be seen by reference to FIG. 6 and 6A, more than two rolls, here three, may be used in order to calculate the number or event for each three dice group. For example, in 6A, it can be seen that each column has three sets of dice shown. All of the dice are shown identically, so they are identified as the first column 101 has three different dice rolls 108, 109 and 110. Each of these dice rolls shows two separate dice, for example 110*a* and 110*b*.

As displayed in FIG. 6, to achieve a result, the machines maybe tied together for a common jackpot. Also as shown in FIG. 6, each column 101–103 may comprise a win based on rolls generating a certain number of points or a certain number of rolls. Another embodiment, combining the two concepts would be to (1) look to each column to see if a target number is generated and (2) add the points in all rolls in all columns (or alternatively the average of the points in each column) to determine if a sufficient number of points is achieved to win another outcome.

Figure 9:
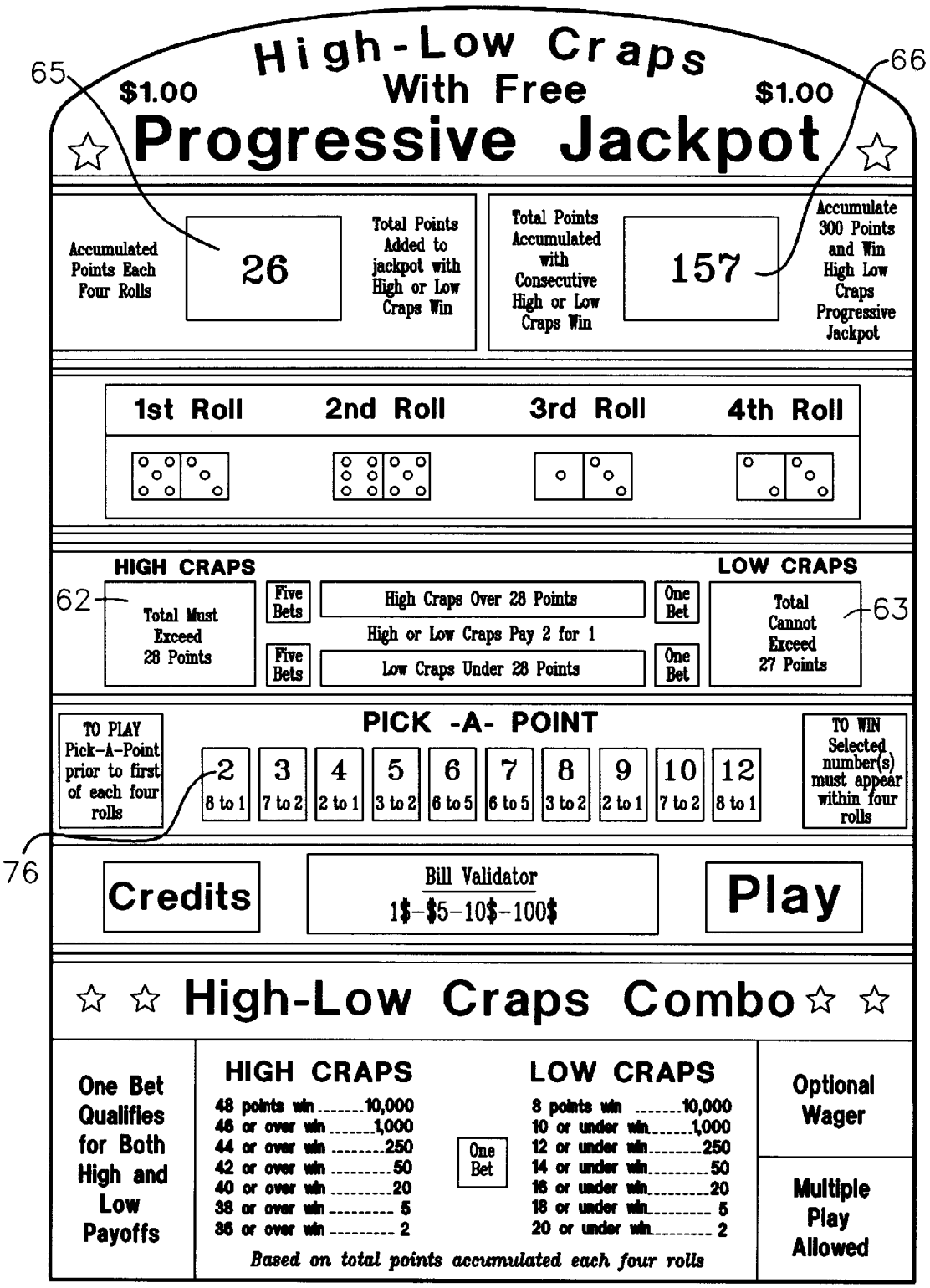
FIG. 9 is an alternate embodiment of the game shown in FIG. 5.

The number of consecutive rolls could be increased as shown in FIG. 7 or FIG. 9 or could be decreased depending on the number of rolls or points comprising a winning outcome, for example three rolls no seven or, alternatively, four rolls no seven to win.

Credits could affect the rolls. For example, the first credit could give up to 10 rolls, the second credit up to 20 rolls, etc.

Obviously, any combination of the variations set forth above in items 1–5 and their sub-parts could be used.

In this way, roller's entire roll run (a number of consecutive rolls before rolling a target number, such as a '7') in the background with odds placed on all or some of the numbers would generate a highly randomized payout. The dice may be from 1 to an infinite number and the number of sides of each dice may be likewise changed.

It should be noted that all number generation in a video format would take place on a computer platform. Only the payout need be shown, although each consecutive roll, odds played, payout on each roll, etc. could also be shown to enhance player participation.

In another embodiment, the player would place each bet individually. Since this requires a template for the player to make the wagers, FIG. 3 is provided to show an example of the template which could be used.

In this embodiment, the player would put money into a slot 46 provided in a slot machine and generated credits would appear in the credit location 47. The player could have these credits returned to the player by hitting player payout location 48. This would allow the player to 'cash out'. To make a wager the player would touch the wager amount location 49. In this location 49 a number would appear from I to a predetermined maximum. Each time the player touched this location 49 the number appearing would increase. By touching the credit location 47 the number in the wager location 49 would return to zero. When the number in the wager location 49 satisfied the player, the player would touch the "FOUR THE MONEY WAGER" location 2 or the odds wager locations 13–14 to place a wager in the preset amount on the wager location 49 on that location. The wager location 49 would then return to zero, the credit location 47 number would be reduced by the amount of the wager and the wager number would appear on the location where the wager appeared. By selecting this wager again and touching the credit location 47, the wager would be removed and added back to the credit location. This allows the player to vary his play greatly during the game.

When the player had placed all wagers desired, the roll could be selected to generate a number on each set of the dice 101–104 and a payout or forfeiture of wagers would occur depending on the results. In one embodiment, a wager would automatically be made or required to be made on the "FOUR THE MONEY WAGER" location 2 before play on any odds wager location 3–14.

Examples of the games possible are shown in the following examples. These could be used if the game was played by the player as shown in FIG. 3 and 5 or was run in the background with automated wagering with wagers of present or randomly selected amounts.

Although this shows 4 rolls, a counter could show three (3) rolls or as many rolls as desired (in the preferred embodiment up to 40 rolls).

Figure 4C:
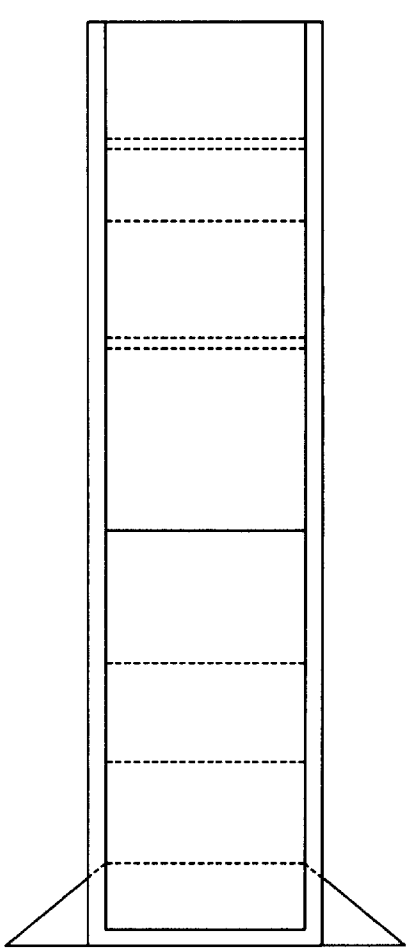
FIGS. 4*a*, 4*b*, and 4*c* are cross sectional views of the chute described herein.
Figure 4B:
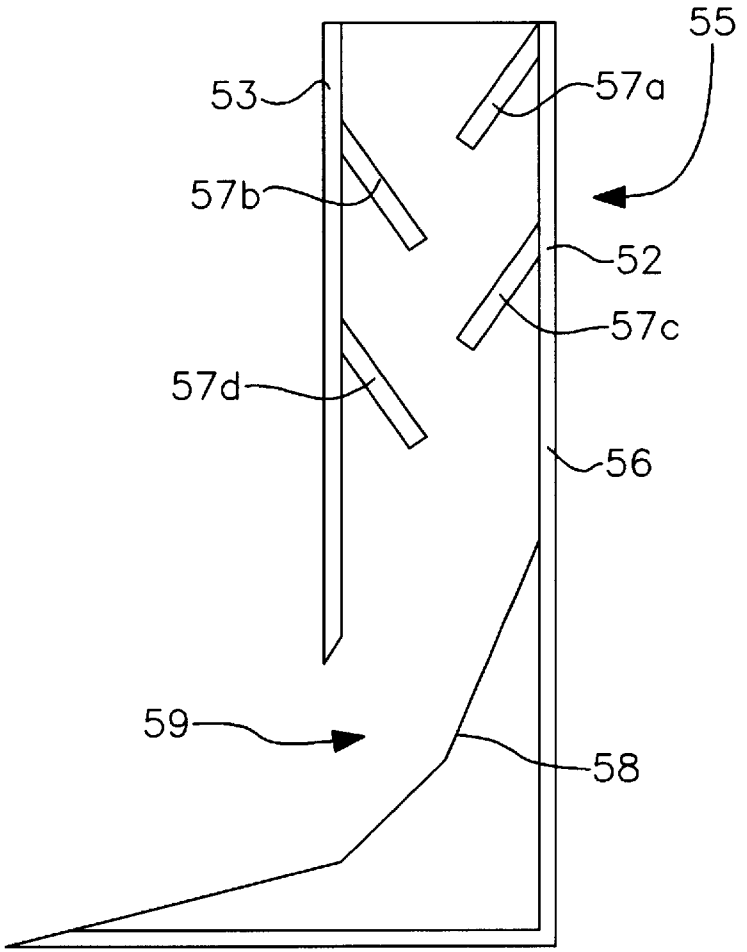
Figure 4A:
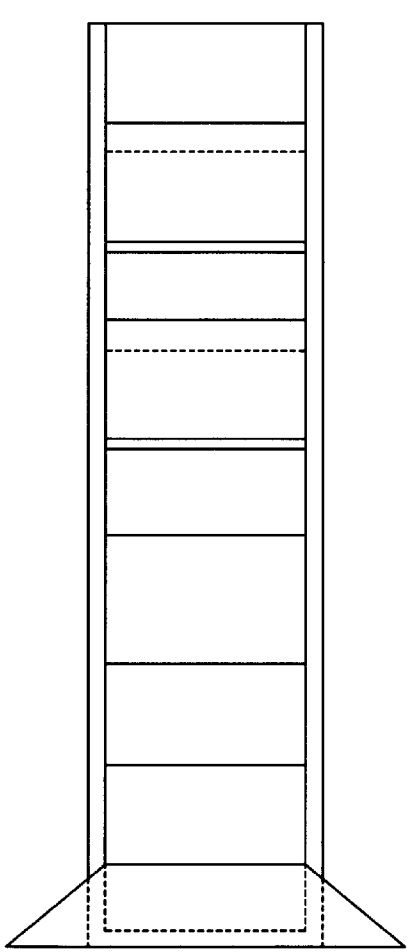

One concept embodied here in is the display with a multiple but preferably four randomly generated dice rolls in a row. In the preferred embodiment these rolls appear along a top row 101*a*, 102*a*, 103*a* and 104*a* and 101*b*, 102*b*, 103*b* and 104*b* a bottom row as shown in FIGS. 3 and 4. The top and bottom row together equal a single roll. Likewise, the total may be displayed with the total of both dice in a single row as shown in FIG. 7 or replacing the dice with the numeric result of their additions.

Video play is initiated with the deposit of money followed by the actuation of the random number generator. All of the results would be altered in favor of the player(except the true odds and "FOUR THE MONEY" wager)in the event that multiple coins were used consistent with current technology.

In one embodiment, there are 8 random results generated, 4 net results are reached by adding these random results. Each of these generate (1) a number between 1 and 6 or a symbol. In order to produce the odds available on the preferred embodiment, each random number generator generates (a) 13 different results, two each for numbers 1–6 and one which is the symbol or (b) 12 different result, two for each number 1–6 and wherein one of the numeric results may be accompanied by a symbol.

1. The numeric result is generated by adding a pair, the top dice roll to the bottom dice roll, for each of four columns. Top and bottom may be replaced with side by side displays without departing from the embodiment set forth herein.

In this embodiment, the symbol may be associated with a number (e.g. 1 and the symbol appearing together) in order to obtain a numeric result greater than one where a symbol is used.

2. If the four generated pairs are generated without a pair total of seven (or other target), a first payout occurs. Without any further action of the player, the game continues in the fashion until a seven is encountered.

In the first embodiment (a), the symbol acts as a free pass since two dice are necessary to generate a seven.

3. The game may also track the number of hard ways.

If a predetermined numbered hard ways are generated before a seven is generated a payout may occur.

For each additional hard way generated before a seven, this total maybe increased.

4. The game may also track the top and bottom row of numbers.

If the same number appears three times across the top, a payout maybe made.

E.G.: three threes in a row across the top could pay 10.00

If the same number appears four times across the top, a heightened payout maybe made.

E.G.: if four tens in a row across the top would pay 100.00.

A symbol 50 could be a wild card. Hence, if two threes and a symbol 50 appeared, the game could pay 10.00 for this combination.

If all the symbols 50 appeared across the top, a higher payout could be made. If all of the symbols appeared across the top and bottom (8 symbols 50 displayed) a jackpot payout could be made. The symbol shown herein is the trademark for the primary wager based on four rolls without a seven (7).

The jackpot could start out at one amount and would increase in increments utilizing a percentage of each wager made.

In addition, the game could allow the player to wager on true odds that a number would appear before a seven in the second embodiment (b). By pushing a button or a touch screen location provided with the number to be selected, the player could chose which numbers to place these odds bets. A wager on the "FOUR THE MONEY" location (four rolls without a seven) would be required to place these wagers.

If the game went through a larger number, here forty rolls, or forty (40) cycles, without a seven appearing, a higher payout could be made and the game would start again.

Video play is initiated with the deposit of money followed by the actuation of the random number generator.

In the preferred embodiment, there are 8 random results generated. These are shown on the screen. Each of these generate (1) a number between 1 and 6 or a symbol. In order to produce the odds available on the preferred embodiment, each random number generator generates (a) 13 different results, two each for numbers 1–6 and one which is the symbol or (b) 12 different result, two for each number 1–6 and wherein one of the numeric results is accompanied by a symbol.

Since the odds in the house favor may not allow for sufficient payout of the bets other than the "FOUR THE MONEY" bet set forth below under the second embodiment (b), in the first embodiment (a) at least one additional symbol result is provided to allow for a payout to the other odds set forth below.

The game may be described as:

a) selecting a target;

b) generating at least two random numbers in response to the application of a credit to the game;

c) Displaying each of the at least two random numbers;

d) providing a credit if the two random numbers occur prior to the target occurring;

or d) providing a credit if the target occurs during the display of the at least two random numbers.

This game could be continuously repeated in exchange for a single coin until a next step, the occurrence of the target number or in traditional craps the crapping out of a player.

A dice type game generated by action of a microprocessor according to a set of rules which provides for termination (such as the rules for craps or "FOUR THE MONEY") would be played out for at least one roller's entire turn and the payout made to the player based on the results of that player's roll where the roll is defined by several different throws of the dice. For example, a craps format roll would be to make a payout until the player made a point and then rolled a seven before making that point. In a "FOUR THE MONEY" format, the roll would be defined in terms of all rolls of the dice prior to the occurrence of a seven.

The game so defined might be further refined by providing that additional bets be made automatically as the game is played. For example, a dollar bet might only make a come out bet plus odds, but as additional wagers were won, additional bets might automatically be placed.

The displays possible include: 1) a single display of a single roll of the dice; 2) a list of multiple rolls scrolled down the screen; 3) a changing payout based on rolls shown in groups or individually on the screen as each group is made.

FIG. 3, which shows a "FOUR THE MONEY" slot machine. Multiple machines may be tied into one High Roller of the Month Jackpot. This is to be distinguished from a multi user game where many players wager on a single player's roll. This machine shows three or four columns 101–104. Each column shows two dice 101*a,* 101*b,* etc. type numeric rolls. Whenever one of the three or four columns adds up to seven (or other target number) the game ends. Until then, numbers may be generated with pay outs. This compares to a typical game on a slot machine where whenever a set is displayed there is a payout. This compares to a typical game on a slot machine where whenever a set is displayed there is a payout. The absence of a set (a seven or other target) generates a payout in this game.

Video play is initiated with the deposit of money followed by the actuation of the random number generator. All of the results would be altered in favor of the player ( except the true odds and "FOUR THE MONEY" wager) in the event that multiple coins were used consistent with current technology.

In the preferred embodiment, there are 8 random results displayed as 101*a,* 101*b,* 102*a,* 102*b,* 103*a,* 103*b,* 104*a,* 104*b* generated. Each of these generate (10 a number between 1 and 6 or a symbol. In order to produce the odds available on the preferred embodiment, each random number generator generates (a) 13 different results, two each for numbers 1–6 and one which is the symbol or (b) 12 different result, two for each number 1–6 and wherein one of the numeric results is accompanied by a symbol.

In addition, the game could allow the player to wager on true odds that a number would appear before a seven in the second embodiment (b). By pushing a button or a touch screen location provided with the number to be selected, the player could chose which numbers to place these odds bets. A wager on the "FOUR THE MONEY" location (four rolls without a seven) would be required to place these wagers.

If the game went through a larger number of cycles or rolls, e.g. 40 cycles, without a seven appearing, a higher payout of 1200 could be made and the game would start again consistent with one version of the table top game.

As can be seen, the major concept lies in having dice rolls generated and having a certain target stop the game.

The technology submitted may be run in the foreground as a screen game or in the background as a means of generating a randomized result and randomized payout. If run in the foreground, a single roll or all of the rolls may be displayed with or without the payout associated with each roll and information on how that payout was generated.

This means that the game may use a single coin to generate a result or may be used to have individualized wagers in the same way wagers are made on the Four the Money table.

The player plays one or more credits. Credits may be in the form of tokens or coins applied or electronically maintained numeric credits.

For each credit (or set of credits) an entire game is run in the background until either of two results occurs:

(1) the target number is reached or (2) a predetermined number repetitions occurs or (3) another termination event occurs.

At this time, a payout is made to the player. For example, using a randomizer to generate results for two six sided dice, numbered 1–6 sequentially, and a target number of 7, a payout of one credit could be made if 4 consecutive numbers were generated prior to the generation of a 7. This amount would be doubled if two sets of 4 consecutive numbers were generated prior to the generation of a seven, tripled for 3 consecutive sets of 4 numbers, etc, up to a predetermined maximum.

If the technology set forth in step g of claim 3 above were utilized, then the credits applied to the game could be split (1) automatically or (2) by election of the player of the game to place certain wagers on 'odds' bets. Preferably, the payout on these wagers would be 'true odds'.

Examples of this automated technology using the dice example set forth above would be:

1) the credit could be divided between odds wagers.

Examples:

(A) one credit could be played (B) the game would internally divide the credit played between the odds bets (C) (I) with or (ii) without a portion of the credit being applied to the odds of a consecutive number of counts being generated before the target number is generated.

(D) the split between odds could be split equally or unequally between selected odds bets (e.g. ⅕ credit on the consecutive count bet set forth in (C), and 2 Thais on 6 & 2 Thais on 8- equal double odds) or could be equally or unequally split between all of the odds (e.g. no credit on the consecutive count wager and 1/10th on the 6& ⅕th on the 8, 2 Thais on the 4, 1/10th on the 10 and ⅕th on the 9).

(F) Similarly, this split between odds could be randomized so that a percentage of the credit was randomly assigned between the different odds wagers.

The number of odds wagers could increase with the number of credits played.

For example, the first credit could go to the wager that a predetermined number of consecutive recurrence of at least one count number between the predetermined minimum and predetermined maximum other than the target number is reached (four using the two six sided dice); the next credit might put an odds wager on the six, the next a second odds wager on the six or a separate wager on the 8, etc.) This division could be (1) randomly assigned or (2) be assigned by direction of the player or (3) could be assigned by pre-programmed directions.

One final embodiment is shown in FIG. 9. The only change in this embodiment from that shown in FIG. 8 and FIG. 5 is the location of a pick a point feature providing true odds wagers 76 on the occurrence of a number before the end of four rolls. The payouts are shown on the display next to the number. For example, the odds of the 2 are 8 to 1. The payout would be 8 token to 1 tokens.

Figure 10:
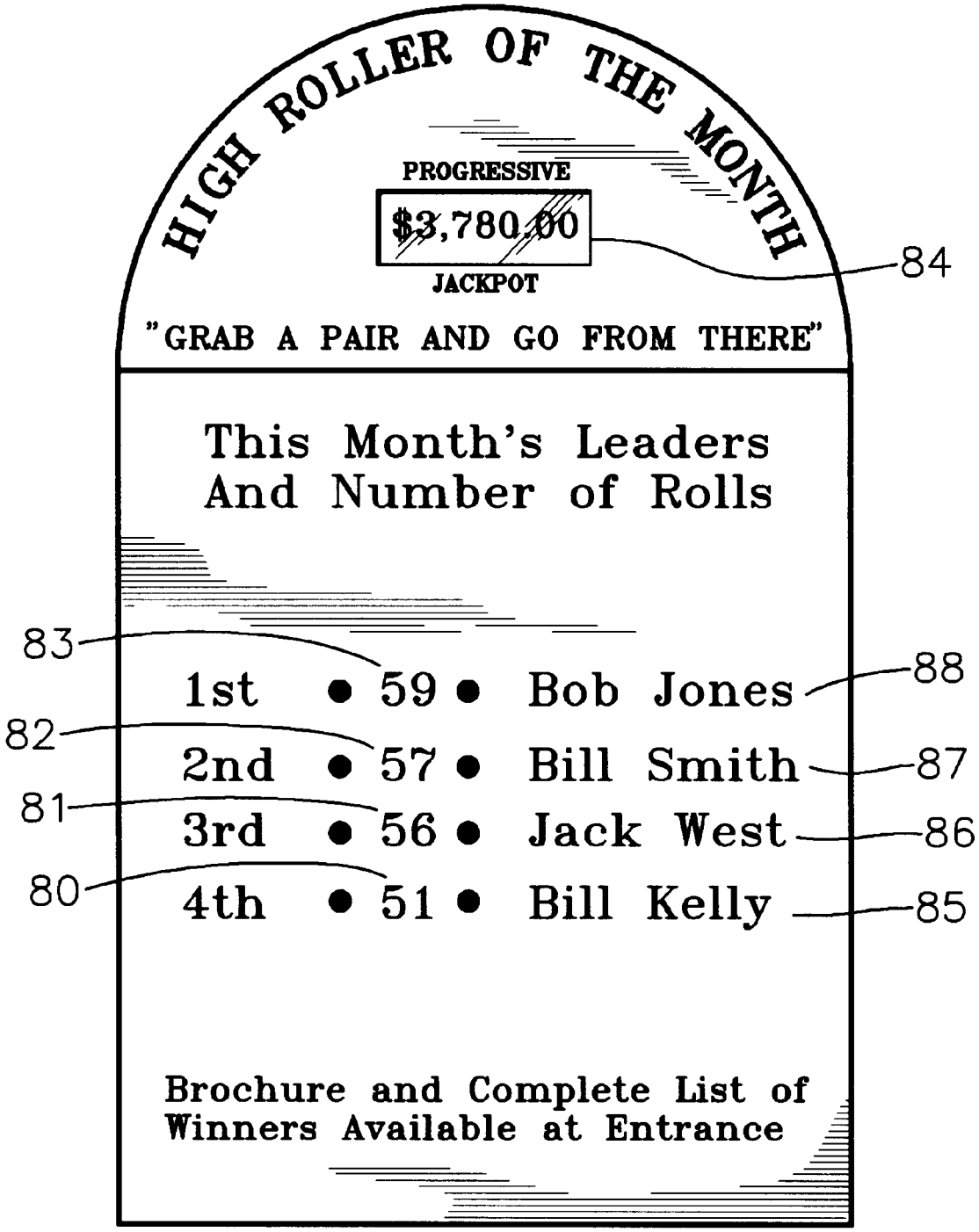
FIG. 10 is a display utilized by the game shown in FIG. 1 or 2.

FIG. 10 shows how the high roller of the month may be displayed with the first 88, second 87 and third 86 and fourth 85 leaders or winners displayed. A portion of the wager necessary to qualify for the high roller payout (based on achieving a certain number of rolls (FIG. 1 or 2 provides this type of payout with the Forty O'Lordy wager 17 with a wager location 60 which has a high payout for rolling forty rolls without a seven) or points (this is shown in FIG. 5 where a count of points is shown at 66 and where a portion of the wager may go towards this jackpot from the other wagers made). In the preferred embodiment, the high roller wager would be $5.00 so that an adequate jackpot could be generated while providing a generous payout to those qualifying (via the high count type payout shown in FIG. 1 or 2 or the High Point payout shown in FIGS. 5, 8 and 9). While this is not specifically designated on the drawings, payouts for achieving more than 300 points in the preferred embodiment would pay between $1000 and $2000 immediately while qualifying the winner for the high roller of the month. The numbers 80–93 displayed on FIG. 10 show the count total (total number of rolls) in the first embodiment of High Roller of the month, although if not minimum number of points were necessary, these could be points. The total jackpot for a given month is shown as $3,780 84.

Figure 11:
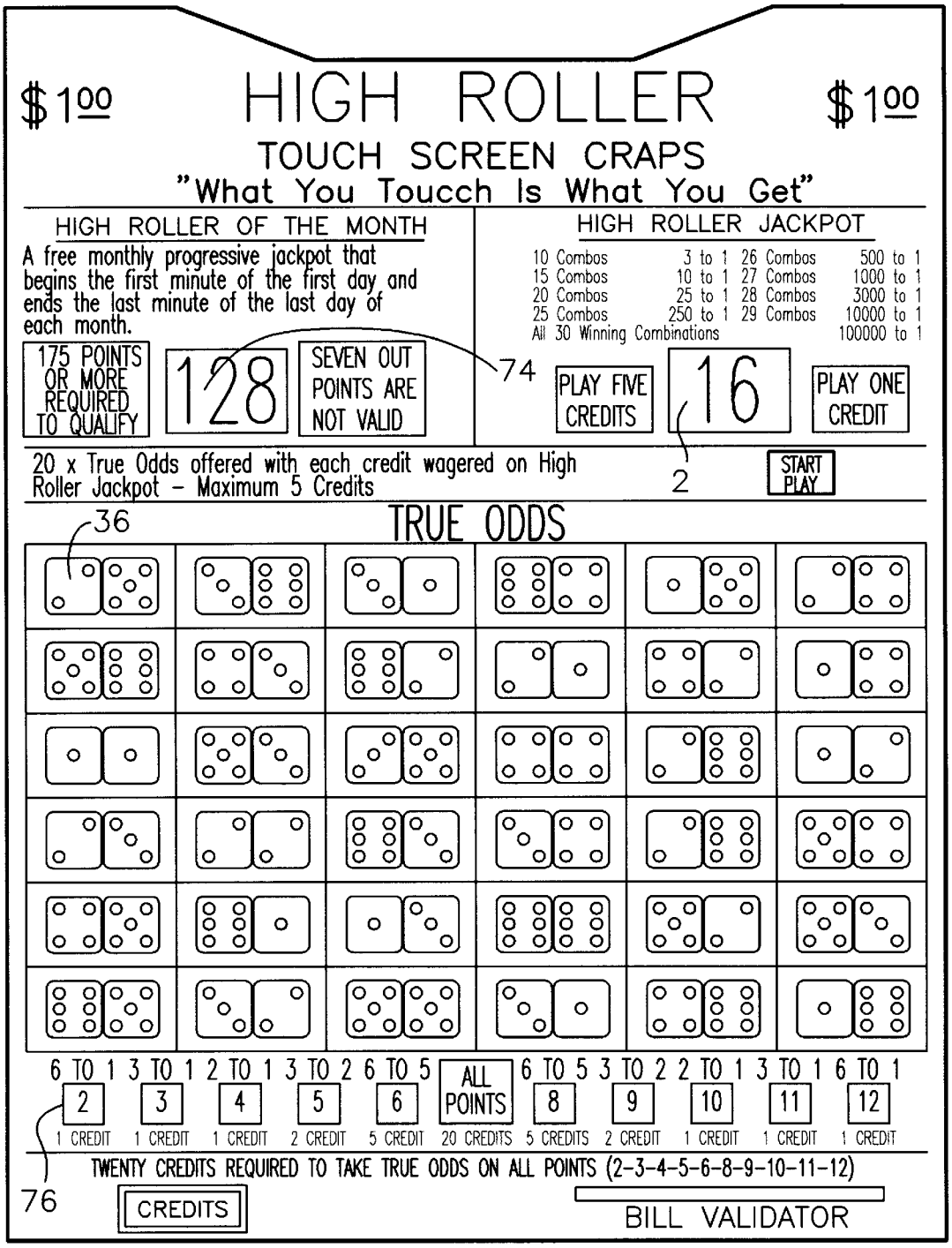
FIG. 11 shows an alternate embodiment of the video format.

FIG. 11 shows an alternative video layout. In this video layout, the dice rolls may be displayed one at a time in response to selections made by the player. In this figure, all of the numbers 36 are shown. However, when actually in play, in this embodiment, the individual numbers would all be covered. The player would then selectively chose one covered spot at a time. As the number was chosen, the underlying number would be disclosed. If a seven, the target number, was uncovered by a touch, then the play would end. Until a seven was selected, the players payout would either (1) increase without penalty or (2) increase, but be subject to complete loss if a seven were selected next. As shown at item 2, the total number of selections before a seven is tracked and a payout is paid based on the odds of making that number of selections (as opposed to rolls with dice, the random numbers are made by election) before a seven is selected. Here, for example, if 16 combos were made before a seven, the payout would be between 15 and 20 combos, and would, therefore, be 10 to 1. The points are also tracked at a point counter 74 which would provide a payout with a sufficiently high payout.

Also, the player may select individual numbers which must be made before a seven and may wager credits on each one at the true odds location 42. At this location, for example, if a 2 was selected and then a two was uncovered before selecting a space covering a seven, the winner would be paid six to one for every one uncovered. It can be noted in this drawing showing all of the numbers covered, that the display preferably shows all 36 possible combinations. More or fewer combinations could be displayed, with the odds adjusted accordingly. A touch screen method of playing craps that offers three unique betting features. A composite payoff based on the number of combinations accumulated prior to a seven out. A monthly paid progressive jackpot based on the number of points accumulated, as well as optional true odds on each point (2-3-4-5-6-8-9-10-11-12) other than a seven that can appear. With this concept participants are the master of their own fate. What you touch is what you get.

Each screen that appears will display 36 different blocks. Behind each block will be one of the 36 different combinations that can appear with two six sided dice bearing numbers one through six. The location of these combinations will be different with each screen that appears. The thrust of this invention is to touch as many different winning combinations as luck will allow prior to a seven appearing. Once a seven does appear play ends and the location of all 36 combinations is revealed.

HIGH ROLLER JACKPOT

The 36 different combinations are concealed behind the 36 blocks that appear on each video screen. Each time a block is touched it reveals that hidden combination and automatically totals the number of winning combinations touched prior to a seven appearing. Once a seven does appear play is automatically ended. There is a total of 30 winning combinations and 6 (seven out) losing ones.

A participant may wager from one to five credits on this feature each time. The availability of optional true odds is based on this wager. Twenty (20) times true odds are available with each credit wagered on this feature when the maximum five credits is wagered 100× true odds are available. All credits won on this feature are paid after play has been completed.

PAYOFF SCHEDULE

| | | | |
|---|---|---|---|
| Accumulate | 10 | Combos | 3 to 1 |
| Accumulate | 15 | Combos | 10 to 1 |
| Accumulate | 20 | Combos | 25 to 1 |
| Accumulate | 25 | Combos | 250 to 1 |
| Accumulate | 26 | Combos | 500 to 1 |
| Accumulate | 27 | Combos | 1,000 to 1 |
| Accumulate | 28 | Combos | 3,000 to 1 |
| Accumulate | 29 | Combos | 10,000 to 1 |
| Accumulate | 30 | Combos | 100,000 to 1 |

Figure 12:
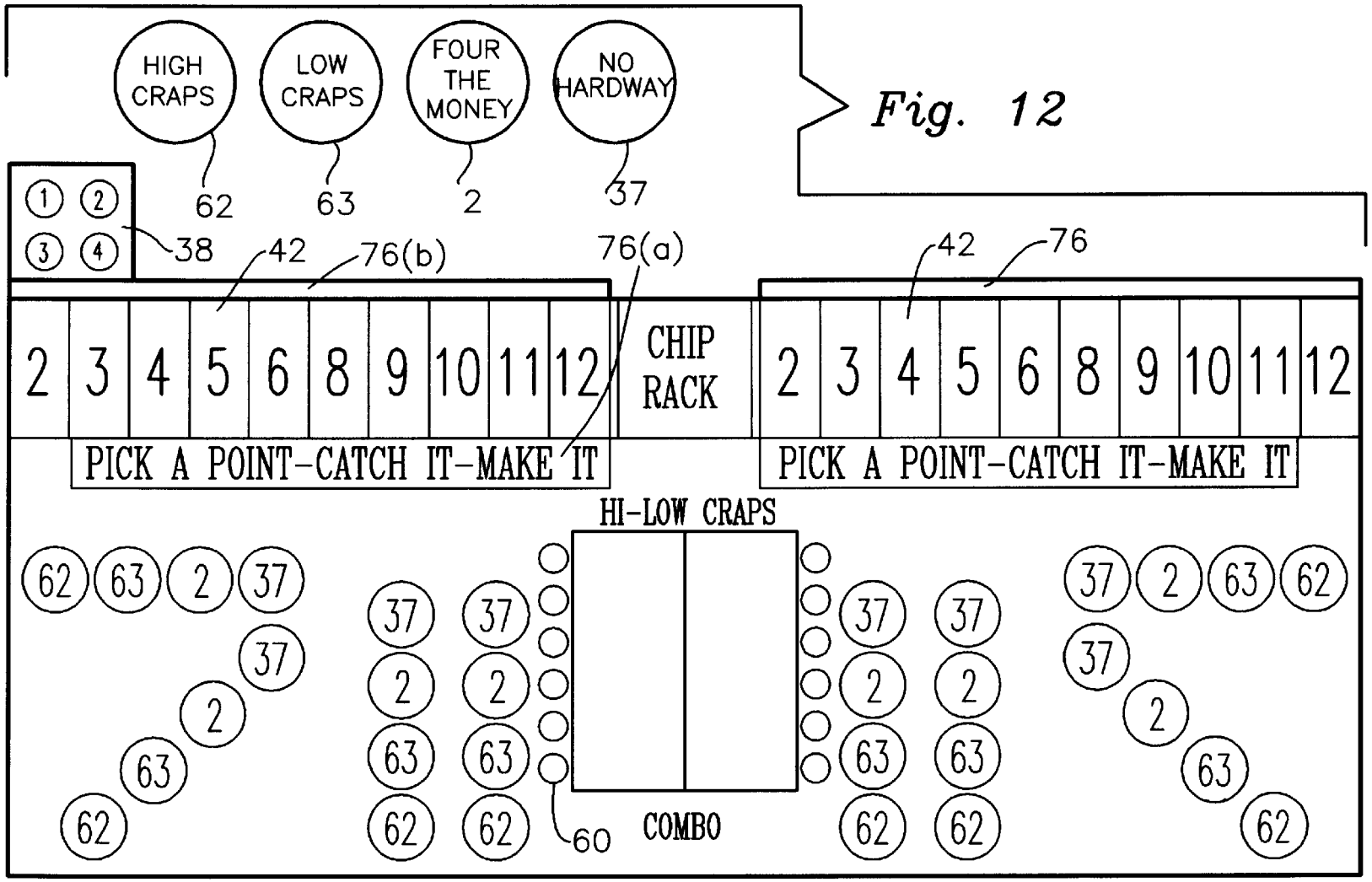
FIG. 12 shows an alternate embodiment of the table game described herein incorporating the odds wagers shown in FIGS. 6 and 9.

FIG. 12 shows a conventional sized dice table embodying a High-Low craps—game. This game incorporates the four the money wager 2, a wager with identical odds, the no hardway wager 37, which is a wager that four rolls would be made before a hardway is rolled. In addition, the high craps wager 62 and low craps wager 63 is provided. True odds wagers 42 may be made on the individual numbers In addition, there are alternative wagers on individual numbers utilizing the pick a point wager 76. This works according to the same method discussed above, except that the player is wagering that the number selected can be made twice before the target number, here seven, is rolled.

The high low craps combo provides the same type of jackpot type payouts as shown in FIG. 9 and described in more detail above. Instead of using a display counter, the count is maintained with a four space counter 38 which uses a marker which is moved from location 1 to 4 displayed on the counter 38.

Numbers on the counter 38, 1-2-3-4, allow bets that have a decision based on every four rolls of the dice. The size of these wagers made on the side bets 2, 37, 63 and 64 should determine the true odds allowed on the true odds wager 42. The pick a point wagers 76 may be similarly controlled. Since these are true odds wager the size would be a multiple of the amount of the wagers on the other locations which are not true odds wagers. In this embodiment, the pick a point wagers are originally placed at original pick location 76*a* under the number selected. For an example, if the player decided to play pick a point on the six, the wager would be placed on the original pick location 76*a* under the number six. After the point is made the first time, the wagers are moved above the 6 to the made pick location 76*b*.

A marker is used by one or both dealers to monitor the number of rolls from one to four by moving it on the four circles numbered one through four on the counter 38.

Wagers may be made on the High-Low Craps jackpot at the jackpot location 60 where a wager location 60 is provided for each player.

The High-Low Craps Combo allows bettors to win either a high or low payoff with a single wager. High- Low Craps Combo works similar to a composite payoff. True Odds are based on a multiple of the players Four The Money, no hard way and high or low craps wagers.

MATH ANALYSIS

1. Four The Money—has a Vig. of 3.55%.
2. No Hardway—has a Vig. of 3.55%.
3. High or Low Craps—has a Vig. of 4.06%.
4. High-Low Craps Combo has a- Vig. of 4.02%.
5. Pick-A-Point-Catch It—Make It has a Vig. of 6.9%

CONVENTIONAL CRAPS

By monitoring the points rolled and the number of points accumulated the following side bet can be offered:

All Or Nothing At All—Rolling all numbers 2 through 12 prior to a seven appearing.

All Small—Rolling numbers 2-34-5-6 prior to a seven appearing.

All Tall—Rolling numbers 8-9-10-11-12 prior to a seven appearing.

Peat and Repeat—The rolling of any random number twice prior to a seven appearing.

Pick-A-Point-Catch-It-Make-It—The rolling of a selected number twice prior to seven out.

Four The Money can be added without a special monitoring method if you allow this side bet to be made prior to the come out roll.

No Hardway—This is also an even money side bet that is identical to Four The Money in that a decision occurs every four rolls.

PICK-A-POINT CATCH IT AND MAKE IT

The modified pick a point, known as catch it and make it shown in FIG. 12 is based on rolling of a pre-selected number twice prior to a seven appearing. A separate pick wager on the pick wager location 76(*a*) and may be made for each of the ten different number sums (2-3-4-5-6-8-9-10-11-12) that can appear on two six sided dice other than a seven. To win this wager the selected number(s) must appear twice prior to rolling a seven. A bettor can select from one to all ten different numbers to wager on. The payoff being determined by the difficulty of achieving the task. Example: as there are two combinations to make an eleven and three combinations to make a ten the payoff will vary with the difficulty. The Shooter does not have to make a number twice in the same fashion, only the total points of both dice is the determining factor. The wager could also be incorporated into a traditional craps table. An example of the mathematical advantage which could be given to the house is listed below.

MATHEMATICAL ANALYSIS

| POINT | TRUE ODDS | PAYOFF | HOUSE ADVANTAGE |
|---|---|---|---|
| 2 | 48 to 1 | 44 to 1 | 8.2% |
| 3 | 15 to 1 | 14 to 1 | 6.3% |
| 4 | 8 to 1 | 7 to 1 | 11.1% |
| 5 | 5.25 to 1 | 5 to 1 | 4.0% |
| 6 | 3.86 to 1 | 7 to 2 | 7.4% |
| 8 | 3.86 to 1 | 7 to 2 | 7.4% |
| 9 | 5.25 to 1 | 5 to 1 | 4.0% |
| 10 | 8 to 1 | 7 to 1 | 11.1% |
| 11 | 15 to 1 | 14 to 1 | 6.3% |
| 12 | 48 to 1 | 44 to 1 | 8.2% |

CATCH IT-PICK-A-POINT-MAKE IT

| 2 | 3 | 4 | 5 | 6 | 8 | 9 | 10 | 11 | 12 |
|---|---|---|---|---|---|---|---|---|---|
| 44 to 1 | 14 to 1 | 7 to 1 | 5 to 1 | 7 to 2 | 7 to 2 | 5 to 1 | 7 to 1 | 14 to 1 | 44 to 1 |

Figure 13:
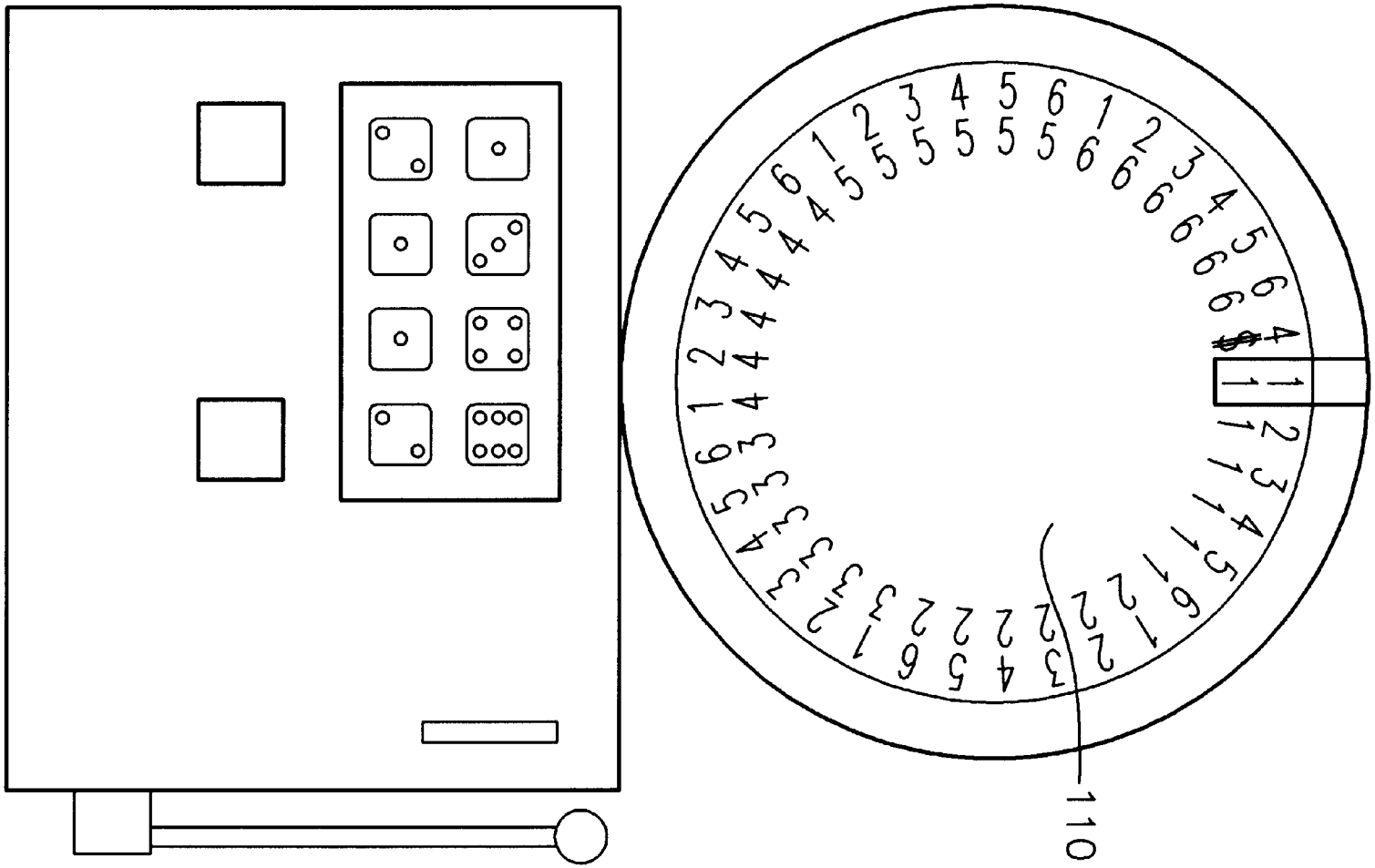
FIG. 13 shows an alternate video embodiment which also incorporates a spinning wheel as opposed to reels.

FIG. 13 shows an alternative of the embodiment shown in FIG. 9. The primary difference, is that one of the rolls may be made selectively using at least one numbered wheel 110, instead of at least one column with the point selected on the wheel by a selection location 111. Payouts of varying multiple dollars may be made by the spinning of the wheel either (1) if it is not a seven or (2) no matter what number is made on the wheel. The wheel may alternatively provide that payouts may be made where the number on the wheel can replace a target number, i.e. a seven, displayed on the reels if a symbol or other special occurrence appears on one of the reels. Here, a symbol shown on the last of the four reels allows the wheel to spin to provide a replacement which is not a seven with a predetermined payout added to the existing payout. The payout may be a multiple times the numbers on the wheel or through a mathematical formula based on the additional occurrence without a seven or based on repeating a number on the display with a display on the wheel.

Figure 14:
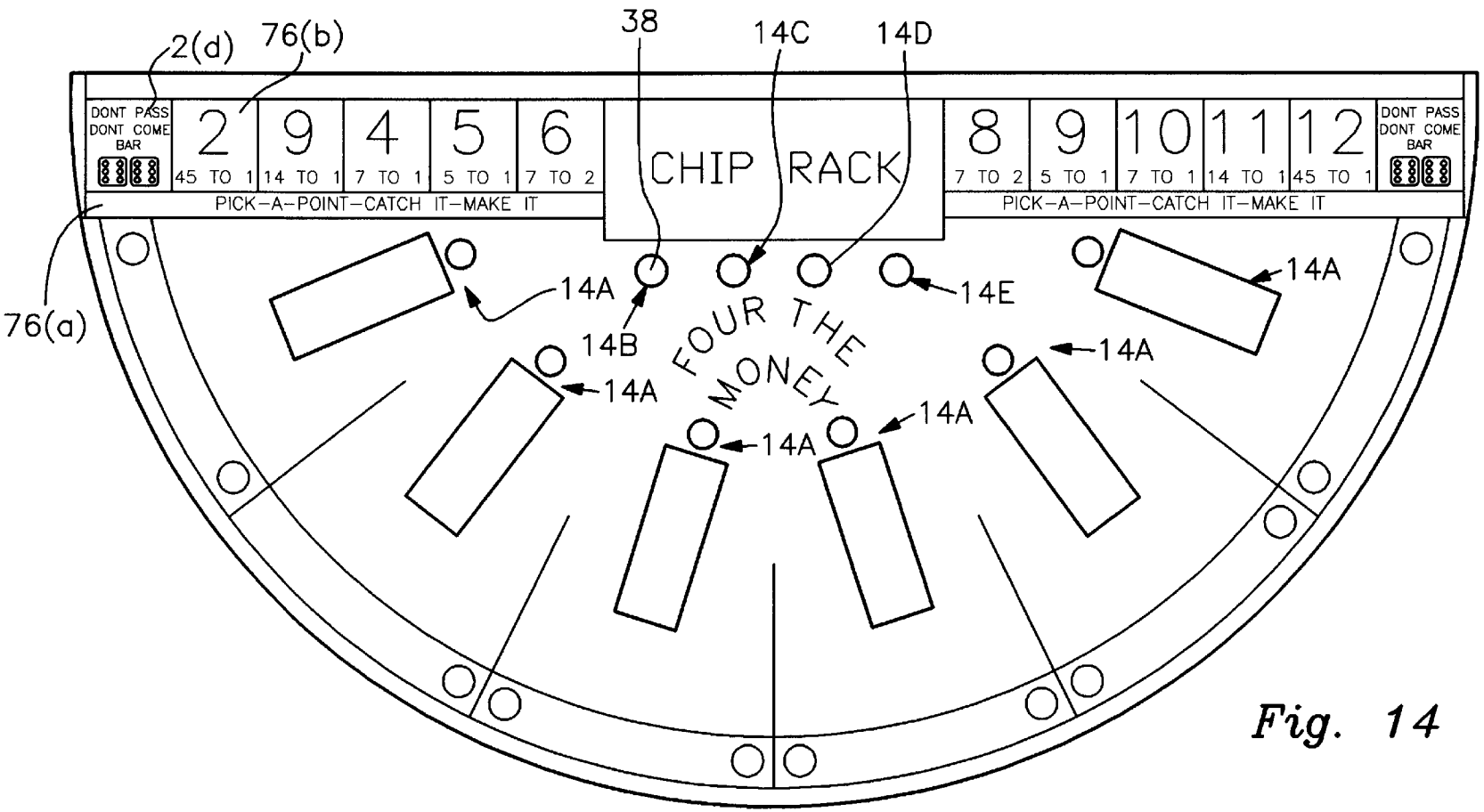
FIG. 14 shows a second alternate embodiment of the invention described in FIG. 12.
Figure 14A:
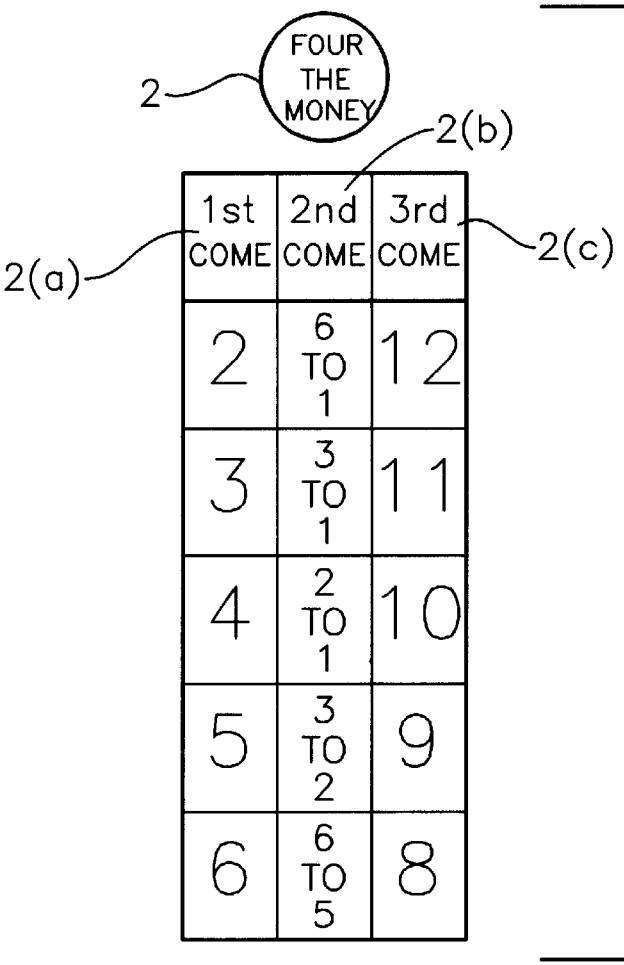
Figure 14C:
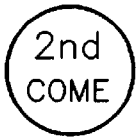
Figure 14B:
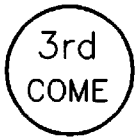
Figure 14E:
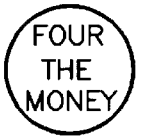
Figure 14D:
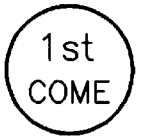

FIG. 14 shows an alternate embodiment of the four the money game described in FIG. 1, except here the pick a point wager 76 is given with a location 76*a* and 76*b* for before making a first time and after making a first time respectively as described in reference to FIG. 12. The counter location 38 allows for a player to make wagers on the first roll through the forth roll on first FTM location 2, Second FTM location (first come) 2*a,* Third FTM location (second come) 2*b* and fourth FTM location (third come) 2*c*. Each of these wagers, 2, 2*a,* 2*b,* and 2*c* require that the player make the next four rolls without a seven being made.

A don't pass location 2*d* may be added which is a wager that is well known in traditional craps.

THE SHUTE

A random number generator for generating numbers between a predetermined minimum and maximum using at least one dice is shown in FIG. 4. This device defines a shute or chute 55 and is covered by the trade name "SHUTE". It preferably is defined as a tower having at least four walls, a top 50 and a bottom 51, said walls including a first opposing wall 52 facing a second opposing wall 53;

b) at least one first shelf 57*a* on said first opposing wall slanting from said first opposing wall towards the bottom having a width and a length away from said first opposing wall;

c) at least one second shelf 57*b* on said second opposing wall slanting from said second opposing wall towards the bottom having a width and a length away from said first opposing wall wherein at least a portion of said second shelf is below said at least one first shelf so that a dice falling from above the at least one first shelf may roll from said first shelf onto said at least one second shelf and from said at least one second shelf to the bottom. As shown in FIG. 4*b* there is a second opposing shelf 57*c* and a second facing shelf 57*d* to adequately randomize the dice.

The slant of the shelves may be reversed so that the dice may be randomized by reversing the direction of the shelves and turning the tower on its top.

The top is open so that the dice may be placed within the top.

The shute has an inside and an outside and the bottom 51 is further defined as having defining an opening 59 from the inside of the tower to the outside of the tower and a ramp 54 which slants from at least one wall towards the bottom and the opening so that the dice, upon landing on the ramp tend to move towards the opening and out of the internal area of the chute.

The opening 59 may be closed with a door (not shown). Also, the bottom 58, may be flat. To provide a greater randomization of the dice, the ramp top surface 121 or bottom flat surface 120 may be uneven or define ridges or bumps.

What is claimed is:

1. A method of playing a betting game using multiple random number generation having a set event which terminates the multiple number generation comprising the steps of:

a) providing at least three columns for viewing;

b) selecting at least one win number from a plurality of predetermined numbers between a predetermined maximum number and a predetermined minimum number on which to make a wager;

c) generating at least one first random number and at least one second random number which may be added to obtain a total so that the total of the at least one first random number and at least one second random number is between the predetermined maximum number and predetermined minimum number;

d) displaying at least one first random number in the first column and at least one second random number in the first column e) repeating step c for each of the at least three columns;

f) comparing the total of the first random number and second random to the at least one win number in at least one of the at least three columns;

g) providing a payout when the win number is the same as the total.

2. The invention of claim 1 further comprising the steps of (a) selecting at least one win combination of numbers comprising at least two numbers between the predetermined and predetermined maximum providing at least one second payout based on the the combination of totals of at least two columns being the same as the win combination.

3. The invention of claim 1 wherein the step of providing a payout further comprises the step of selecting a target number and providing a payout when at least one of the totals is not equal to the target number.

4. The invention of claim 1 wherein the step of selecting at least one win number further comprises the step of displaying a plurality of numbers and allowing a user to select which of the plurality of numbers will be the win number.

5. The invention of claim 4 further comprising the step of providing selections for the user said selections comprising at least one combination of numbers from a predetermined group and providing combination pay-outs based on obtaining the at least one combination of numbers.

6. The method of claim 1 further comprising the steps of:

a) selecting at least one target number as a termination event;

b) setting a first dice maximum and first dice minimum for the at least one first random number and at least one second random number so that the at least one first random number and at least second random number are between the first dice maximum and first dice minimum;

c) selecting at least one sum payout number;

d) comparing the total to the at least one target number;

e) adding a sum value from at least two of the column rolls from the group consisting of the number of points and number of rolls displaying the number of dice rolls or number of points as the rolls or number of points are generated;

f) awarding a payout when the sum value exceeds the at least one sum payout number before the at least one target number is generated.

7. The invention of claim 1 wherein the step of displaying further comprises the step of displaying the at least one first number above the at least one second number.

8. The invention of claim 1 further comprising the step of providing a wheel bearing a plurality of dice rolls wherein the wheel and dice rolls are oriented so that the plurality of dice rolls may be viewed by a user and a selection marker for marking at least one of the plurality of dice rolls so that the selection marker may rotate relative to the wheel and wherein generating at least one first random number and at least one second random number further comprises the step of selecting at least one of the plurality of dice rolls from the wheel.

9. The invention of claim 1 further comprising the step of providing at least one wheel bearing a plurality of dice rolls wherein the wheel and dice rolls are oriented so that they may be viewed by a user and a selection marker for marking at least one of the plurality of dice rolls so that the at least one wheel may rotate relative to the selection marker and further comprising the step of providing at least one random display in addition to the at least one first random number and at least one second random number and further providing that the generation of the at least one random display causes the selection marker to be rotated relative to the at least one wheel to select one of the plurality of dice rolls; setting a wheel target number and further providing a wheel payout when the one of the plurality of dice rolls is equal t the wheel target number.

10. The invention of claim 1 wherein the at least one first random number and at least one second random number are between one and six and wherein the predetermined maximum number is 12 and the predetermined minimum number is 2.

11. The invention of claim 10 wherein the step of displaying further comprises displaying the numbers as if they were dice.

12. The invention of claim 11 further comprises displaying at least four columns.

13. The invention of claim 10 wherein the step of displaying further comprises the step of displaying only one number at a time.

14. The invention of claim 1 wherein the total is displayed in the column with the at least one first random number and at least one second random number.

15. The invention of claim 1 wherein the payout is a function of the statistical odd of the total being equal to the win number.

* * * * *